US010625971B2

(12) United States Patent
Horiguchi

(10) Patent No.: US 10,625,971 B2
(45) **Date of Patent: *Apr. 21, 2020**

(54) APPARATUS FOR PROCESSING SHEETS, APPARATUS FOR FORMING IMAGES AND METHOD OF PRESSING FOLDS OF SHEETS

(71) Applicant: CANON FINETECH NISCA INC., Misato-Shi, Saitama (JP)

(72) Inventor: Satoshi Horiguchi, Yamanashi-ken (JP)

(73) Assignee: CANON FINETECH NISCA INC., Misato-Shi, Saitama (JP)

( * ) Notice: Subject to any disclaimer, the term of this patent is extended or adjusted under 35 U.S.C. 154(b) by 37 days.

This patent is subject to a terminal disclaimer.

(21) Appl. No.: 15/416,650

(22) Filed: Jan. 26, 2017

(65) Prior Publication Data

US 2017/0217714 A1 Aug. 3, 2017

(30) Foreign Application Priority Data

Jan. 29, 2016 (JP) ..... 2016-015716
Jan. 29, 2016 (JP) ..... 2016-015717

(51) Int. Cl.
*B65H 45/18* (2006.01)
*G03G 15/00* (2006.01)

(52) U.S. Cl.
CPC ..... *B65H 45/18* (2013.01); *G03G 15/6541* (2013.01); *B65H 2801/27* (2013.01); *G03G 2215/00877* (2013.01)

(58) Field of Classification Search
CPC ..... B65H 2301/4505; B65H 23/16; B65H 2301/51232; B65H 2701/13212
See application file for complete search history.

(56) References Cited

U.S. PATENT DOCUMENTS

| | | | | |
|---|---|---|---|---|
| 7,431,274 | B2 | 10/2008 | Kushida et al. | |
| 7,673,862 | B2 | 3/2010 | Kushida et al. | |
| 8,201,815 | B2 | 6/2012 | Sasahara et al. | |
| 9,897,962 | B2 * | 2/2018 | Osada | G03G 15/6582 |
| 9,919,893 | B2 * | 3/2018 | Fukasawa | B65H 45/18 |
| 2006/0263174 | A1 | 11/2006 | Oikawa et al. | |
| 2009/0010737 | A1 | 1/2009 | Li et al. | |
| 2009/0137374 | A1 * | 5/2009 | Kobayashi | B65H 45/18 493/424 |

(Continued)

FOREIGN PATENT DOCUMENTS

| | | |
|---|---|---|
| JP | 4217640 B2 | 2/2009 |
| JP | 4514217 B2 | 7/2010 |

(Continued)

*Primary Examiner* — Jennifer E Simmons
(74) *Attorney, Agent, or Firm* — Manabu Kanesaka

(57) ABSTRACT

The present sheet processing apparatus is to obtain that folding in the center portion in the width direction of sheets is made, folding in the end portion is made more reliably by repeatedly pressing the end portion in the width direction, the folded sheets are harder to open, the appearance is also enhanced, and that collection characteristics are improved in stacking bunches of folded sheets, a sheet processing apparatus is provided with pairs of press members (press rollers 70) that press a folded loop BL of folding sheets BS, and a support unit 56 that shifts in the width direction of the folding sheets, while supporting a plurality of rows with a distance between the press members narrowed stepwise in the shift direction.

19 Claims, 23 Drawing Sheets

(56) References Cited

U.S. PATENT DOCUMENTS

| | | | |
|---|---|---|---|
| 2011/0176891 | A1 | 7/2011 | Urano |
| 2014/0077436 | A1 | 3/2014 | Hata et al. |
| 2015/0375957 | A1 | 12/2015 | Fukusawa et al. |
| 2015/0375958 | A1 | 12/2015 | Fukusawa et al. |
| 2016/0154363 | A1 | 6/2016 | Osada |
| 2016/0214828 | A1 | 7/2016 | Osada et al. |
| 2016/0264374 | A1 | 9/2016 | Katsumata et al. |

FOREIGN PATENT DOCUMENTS

| | | | |
|---|---|---|---|
| JP | 2012-201462 | A | 10/2012 |
| JP | 2014-76903 | A | 5/2014 |
| JP | 2016-011191 | A | 1/2016 |

* cited by examiner

APPARATUS FOR PROCESSING SHEETS, APPARATUS FOR FORMING IMAGES AND METHOD OF PRESSING FOLDS OF SHEETS

BACKGROUND OF THE INVENTION

1. [Field of the Invention]

The present invention relates to an apparatus for folding sheets which are sequentially carried out of an image formation apparatus such as a copier and printer and are collected as a bunch, and more specifically, to a sheet processing apparatus for pressing a folded loop of a bunch of folded sheets and performing processing so as not to open the folded sheets after discharging, an image formation apparatus provided with the sheet processing apparatus, and a method of pressing a fold of sheets.

2. [Description of the Related Art]

Generally, processing apparatuses are widely known which collate sheets carried out of an image formation apparatus, and perform staple binding or folding in the form of a booklet. Some of these processing apparatuses perform saddle stitching on the middle of sheets with staples or adhesive and fold in the form of a booklet. Such apparatuses perform processing for folding a bunch of 2 or 3 sheets up to about 30 sheets in two. However, after discharging, the folded loop portion subjected to the folding processing is open, and a collection amount of bunches of folded sheets is thereby decreased.

Therefore, for the folded loop portion of the sheets folded in two once subjected to the folding processing, processing is known to press a bunch of the sheets again from frontside and backside of the loop portion.

Japanese Unexamined Patent Publication No. 2016-11191 (corresponding Publication of US Patent Application No. 2015/0375958A1) filed by the present applicant shows an apparatus that shifts while applying narrow pressure, with paired press rollers narrowing stepwise, in the vertical direction of a folded loop along the folded loop of sheets folded in two. By this means, instead of pressing only the fold of sheets with press roller as in the conventional manner, the fold facing inward is added by the press rollers for pressing stepwise, the folding sheets folded with the fold facing inward generated in the fold of the sheets are hard to open, and the collection amount is improved.

However, even in the apparatus of above-mentioned Japanese Unexamined Patent Publication No. 2016-11191 (corresponding Publication of US Patent Application No. 2015/0375958A1), it was understood there was still room for improvement by the search of the present applicant. In other words, sheets are provided with fold lines inside by a plurality of rows of press rollers with different mutually opposed distances, and are certainly harder to open than in the conventional apparatus. However, when the number of folding sheets increases, the fold line is added to the center portion in the width direction of folding sheets, but the vicinities of end portions are not provided with the fold line so much, and it is not possible to fold reliably. When this phenomenon was analyzed, the phenomenon occurred from the fact that stiffness of sheets is strong in the center in the width direction of the folded loop of folding sheets, and is weaker as the portion nears the end portion. Further, it was also understood that the fold line is harder to add on the carrying-our side than the entry side of a plurality of press rollers with different distances. It is assumed that this phenomenon occurs from the fact that sheets are continued in the entering direction on the entry side, continuation of sheets is a little on the carrying-out side, and that stiffness of the folded sheet is weak.

The present invention was made for further improvements as described above, and it is a first object to reliably fold also end portions in the width direction of folding sheets by pressing the end portion in the width direction a plurality of times, while pressing the entire region in the width direction of a folded loop of the folding sheets.

Further, it is a second object to execute pressing the end portion in the width direction a plurality of times when necessary, in order to reliably press also the end portion in the width direction of sheets.

SUMMARY OF THE INVENTION

In order to attain the first object, in the disclosure herein, the following configuration is adopted.

A sheet processing apparatus is provided with pairs of press members that press a folded loop of folding sheets, and a support unit that shifts in the width direction of the folding sheets, while supporting a plurality of rows with a distance between the press members narrowed stepwise in a shift direction, where the support unit performs a sheet width entire region shift and reciprocating motion in a sheet end partial region of the folded loop, and presses the folded loop with the press members.

Further, in another disclosure to attain the second object, the following configuration is also adopted.

A sheet processing apparatus is provided with pairs of press members that press a folded loop of folding sheets, a support unit that shifts in the width direction of the folding sheets, while supporting a plurality of rows with a distance between the press members narrowed stepwise in a shift direction, and a control section that controls a shift in the width direction of the support unit, where the control section selectively performs an entire region pressing shift for the support unit to press a sheet width entire region of the folded loop with the press members, and an end portion region pressing shift for pressing a width end portion of the folded loop by performing reciprocating motion in a sheet end portion region, in addition to the entire region pressing shift.

BRIEF DESCRIPTION OF THE DRAWINGS

FIG. 9A is a perspective view where the guide plate is positioned in a second upper press roller unit, and FIG. 9B is a cross-sectional explanatory view of the perspective view;

FIG. 10A is a support view where the guide plate is positioned in a first upper press roller unit, and FIG. 10B is a cross-sectional explanatory view of the perspective view;

FIG. 14A is a view illustrating a state of being pressed by the first upper press roller and first lower press roller, FIG. 14B is a view illustrating a state of being pressed by the second upper press roller and second lower press roller, and FIG. 14C is a view illustrating a state of being pressed by the last third upper press roller and third lower press roller;

FIG. 15A illustrates a bunch of folding sheets pressed by the support unit shown in FIGS. 1 to 13 and a state in which folding of end portions in the width direction is loose, FIG. 15B is an explanatory view of a folded state of the end portion in the sheet width direction on the entry side of the support unit, and FIG. 15C is an explanatory view of a folded state of the end portion in the sheet width direction on the carrying-out side of the support unit;

FIG. 17A illustrates operation for discharging a bunch of sheets for each shift in the width direction of the support unit, and FIG. 17B is an explanatory view of an operation state of the support unit susceptible to improvement up to FIGS. 15A to 15C where the support unit reciprocates to the carrying-out side after entering and then, discharges a bunch of sheets;

FIG. 18A illustrates a state in which the support unit reciprocates in a portion of a sheet loop in the end portion on the carrying-out side to press, and FIG. 18B is an explanatory view where the support unit reciprocates in a portion of the sheet loop in the end portion on the carrying-out side to press, and then, returns to the entry side;

FIG. 19A is a view illustrating a state in which the support unit reciprocates in each of end portions on the entry side and the carrying-out side in the width direction of folded sheets, and then, discharges a bunch of sheets, and FIG. 19B is a view illustrating a state in which the support unit reciprocates in each of end portions on the entry side and the carrying-out side in the width direction of the sheets, and then, discharges a bunch of sheets after returning to the entry side;

FIG. 20A illustrates a bunch of folding sheets pressed by the support unit and further illustrates a state of a booklet made firm in the end portions in the width direction as compared with FIG. 15A that is the folded view, FIG. 20B is an booklet explanatory view of a folded state pressed by reciprocating in the end portion in the sheet width direction on the entry side of the support unit, and FIG. 20C is another booklet explanatory view of a state pressed by reciprocating in the end portion in the sheet width direction on the carrying-out side of the support unit;

DESCRIPTION OF THE EMBODIMENTS

The present invention will specifically be described below based on Embodiments shown in drawings. An image formation system shown in FIG. 1 is comprised of an image formation apparatus A and sheet processing apparatus B, and a folding unit 50 is incorporated into the sheet processing apparatus B.

[Configuration of the Image Formation Apparatus]

Figure 1:
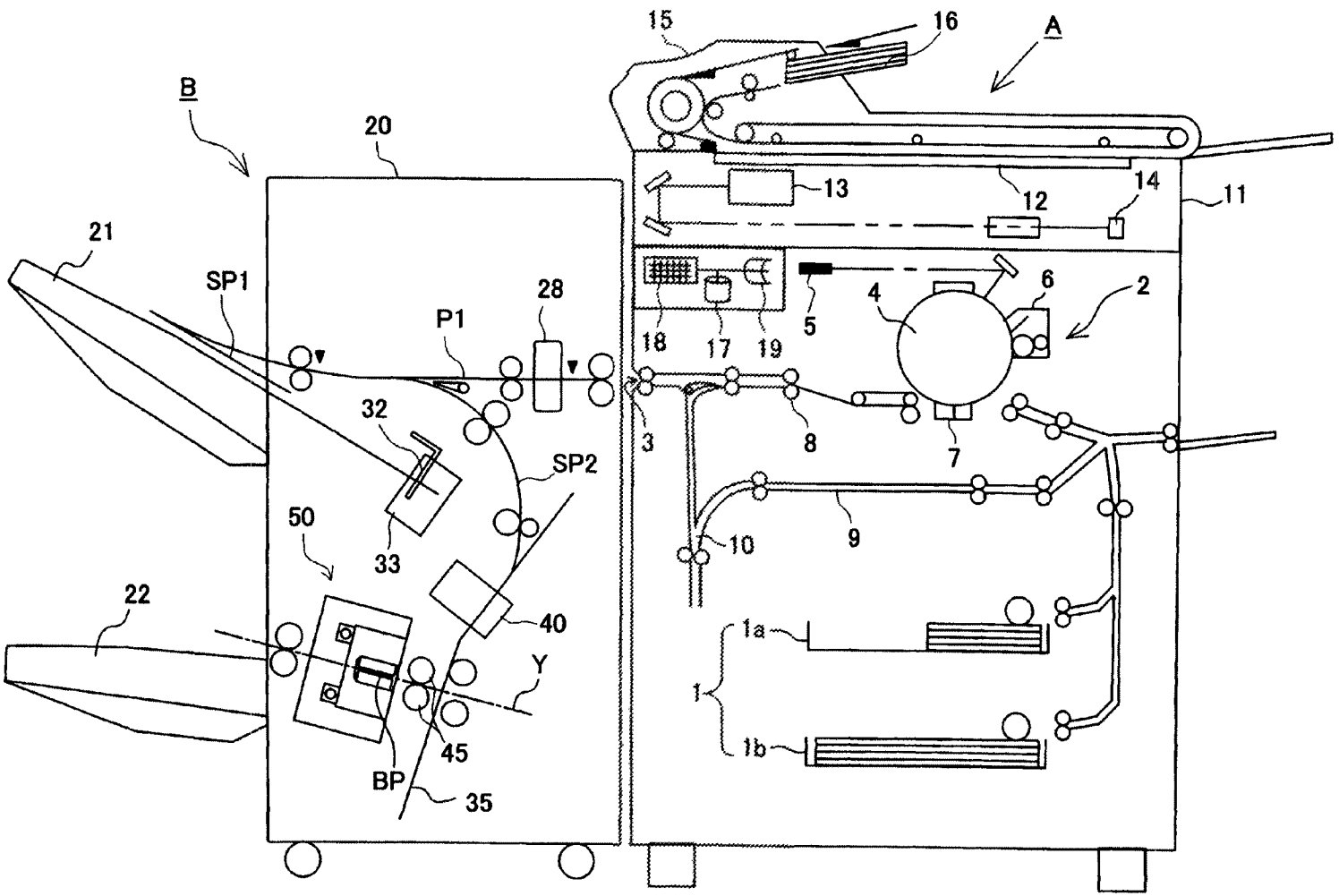
FIG. 1 is an explanatory view illustrating an entire configuration obtained by combining an image formation apparatus and sheet processing apparatus with a folding unit according to the present invention incorporated.

The image formation apparatus A shown in FIG. 1 feeds a sheet from a paper feed section 1 to an image formation section 2, prints on the sheet in the image formation section 2, and then, discharges the sheet from a main-body discharge outlet 3. The paper feed section 1 stores sheets of a plurality of sizes in paper feed cassettes 1*a*, 1*b*, and separates designated sheets on a sheet-by-sheet basis to feed to the image formation section 2. For example, in the image formation section 2 are disposed an electrostatic drum 4, and a printing head (laser light-emitting device) 5, development device 6, transfer charger 7 and fuser 8 disposed around the drum. An electrostatic latent image is formed on the electrostatic drum 4 with the laser light-emitting device 5, the development device 6 adds toner to the latent image, and the image is transferred onto a sheet with the transfer charger 7, and is fused with the fuser 8. The sheet with the image thus formed is sequentially carried out from the main-body discharge outlet 3. "9" shown in the figure denotes a circulation path which is a path for two-side printing for reversing the side of the sheet with printing made on the frontside from the fuser 8 via a switchback path 10, and then feeding to the image formation section 2 again to print on the backside of the sheet. The sheet thus subjected to two-side printing is reversed in the switchback path 10, and then, is carried out from the main-body discharge outlet 3.

An image reading apparatus is shown by "11" in the figure, and scans an original document sheet set on platen 12 with a scan unit 13 to electrically read with a photoelectric converter 14 via reflecting mirrors and condenser lens. For example, the image data is subjected to digital processing in an image processing section, and then, is transferred to a data storage section 17, and an image signal is sent to the laser light-emitting device 5. Further, "15" shown in the figure denotes an original document feeding apparatus, and is a feeder apparatus for feeding original document sheets stored in an original document stacker 16 to the platen 12.

The image formation apparatus A with the above-mentioned configuration is provided with a control section (controller), and from a control panel 18, is set for image formation conditions, for example, such as sheet size designation, color/monochrome printing designation, the number of print copies designation, one-side/two-side printing designation and enlarged/reduced printing designation as print-out conditions. On the other hand, the image formation apparatus A stores the image data read with the scan unit 13 or image data transferred from an external network in the data storage section 17. It is configured that the image data is transferred from the data storage section to a buffer memory, and that the buffer memory 19 sequentially transfers a data signal to the laser light-emitting device 5.

[Configuration of the Sheet Processing Apparatus]

Figure 2:
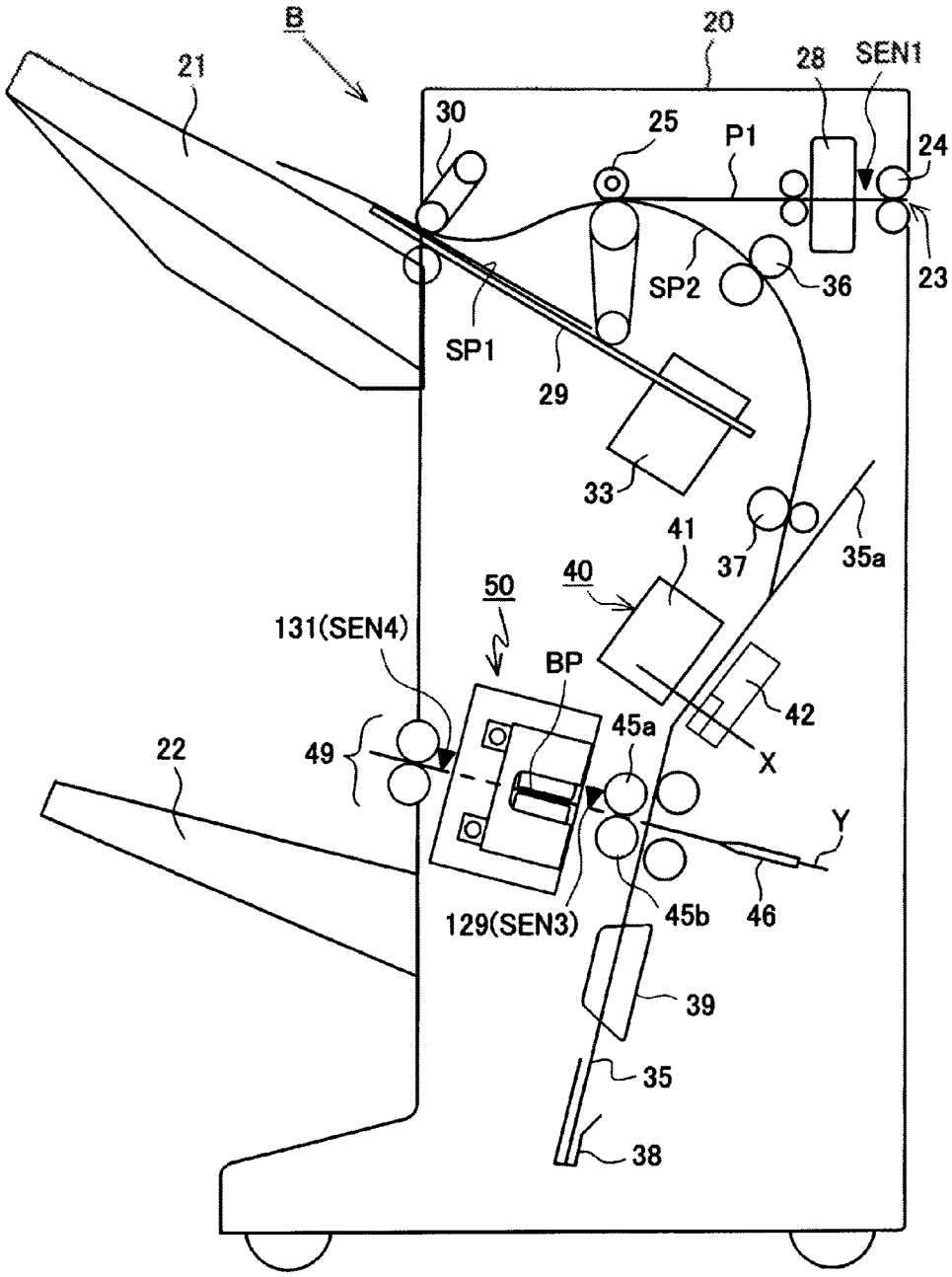
FIG. 2 is an entire explanatory view of the sheet processing apparatus with the folding unit according to the invention incorporated.

As shown in FIG. 2, the sheet processing apparatus B coupled to the above-mentioned image formation apparatus A is provided with a first sheet discharge tray 21 and second sheet discharge tray 22 in a casing 20, and is further provided with a sheet carry-in path P1 having a carry-in entrance 23 connected to the main-body discharge outlet 3. On the downstream side of carry-in rollers 24 is disposed a carry-in sensor Sen for detecting carry-in of a sheet.

The sheet carry-in path P1 is comprised of a linear path substantially in the horizontal direction in the casing 20. Then, disposed are a first switchback transport path SP1 and second switchback transport path SP2 branched off from the sheet carry-in path P1 to carry the sheet in the reverse direction. Then, the first switchback transport path SP1 is branched off from the sheet carry-in path P1 on the downstream side of the path, the second switchback transport path SP2 is branched off from the path P1 on the upstream side of the path, and both transport paths are disposed, while being spaced a distance apart from each other.

In such a path configuration, in the sheet carry-in path P1 are disposed the carry-in rollers 24 and sheet discharge roller 25. The sheet discharge roller 25 is capable of rotating forward and backward. Further, in the sheet carry-in path P1 is disposed a path switching piece (not shown) for guiding a sheet to the second switchback transport path SP2, and the piece is coupled to an actuation means such as a solenoid. Further, in the sheet carry-in path P1, a single-sheet punching unit 28 for performing punching processing on the sheet from the carry-in entrance 23, for example, on a sheet-by-sheet basis is provided on the downstream side of the carry-in rollers 24 and carry-in sensor Sen1.

[Configuration of the First Switchback Transport Path SP1]

As shown in FIG. 2, the first switchback transport path SP1 is configured as described below. The sheet discharge roller 25 is provided at an exit end of the sheet carry-in path P1, and a processing tray 29 is provided to load and support a sheet of the sheet discharge roller 25. Above the sheet processing tray 29 is disposed a forward/backward rotation roller 30 capable of moving up and down between a position for contacting a sheet on the tray and a separated waiting position. The forward/backward rotation roller 30 is controlled to rotate in a clockwise direction in FIG. 2 when a sheet enters onto the processing tray 29, and to rotate in a counterclockwise direction after the sheet rear end is discharged from the sheet discharge roller 25 and enters onto the tray. Accordingly, the first switchback transport path SP1 is configured on the processing tray 29. An end-face stitching staple apparatus 33 is disposed in a rear end portion in the sheet discharge direction of the processing tray 29. The staple apparatus 33 performs staple binding on a single or a plurality of portions in the rear end edge of a bunch of sheets collected on the processing tray 29. The binding-processed bunch of sheets is discharged to the first sheet discharge tray 21.

[Configuration of the Second Switchback Transport Path]

A configuration of the second switchback transport path SP2 branched off from the sheet carry-in path P1 will be described. As shown in FIG. 2, the second switchback transport path SP2 is a transport path for guiding a sheet that is switchback transported from forward to backward with the sheet nipped by the sheet discharge roller 25. As shown in FIG. 2, the transport path is disposed substantially in the vertical direction in the casing 20, transport rollers 36 are disposed at a path entrance, and exit transport rollers 37 are disposed at a path exit. Further, on the downstream side of the second switchback transport path SP2 is provided a stacker section 35 constituting a second processing tray for collating sheets sent from the transport path to temporarily collect. The stacker section 35 shown in the figure is comprised of a transport guide for carrying a sheet. In the stacker section 35 are disposed a saddle stitching stapler 40 and folding rollers 45. These configurations will sequentially be described below.

[Configuration of the Stacker Section]

The stacker section 35 is formed of a guide member for guiding transport of a sheet, and is configured to load and store sheets on the guide. The stacker section 35 shown in the figure is connected to the second switchback transport path SP2, and is disposed substantially in the vertical direction in the center portion of the casing 20. By this means, the apparatus is configured to be small and compact. The stacker section 35 is formed in a length shape for storing maximum size sheets inside, and particularly, the stacker shown in the figure is configured in a curved or bent shape so as to protrude to the side on which the saddle stitching stapler 40 and folding rollers 45 (45*a*, 45*b*) are disposed.

To the rear end side in the transport direction of the stacker section 35 is coupled a switchback entry path 35*a* overlapping an exit end of the second switchback transport path SP2 described previously. This is because of ensuring the order of pages of sheets to collect by overlapping a front end of a carry-in (subsequent) sheet sent from the exit transport roller 37 of the second switchback transport path SP2 and a rear end of a loaded (prior) sheet supported by the stacker section 35. Further, in the stacker section 35, a front end regulating member (hereinafter, referred to as stopper 38) as a stopper means for regulating the front end in the carry-in direction of the sheet is disposed on the downstream side of the guide. The stopper 38 is supported by a guide rail or the like to be able to shift along the stacker section 35, and is configured to shift to a position to carry the sheet in the stacker section 35, a binding position in the middle in the collection direction, and a position for folding with the folding rollers 45 by a shift means not shown. Further, an alignment member 39 for aligning the sheet is provided in the middle in the transport direction of the stacker section 35, and presses side edges to align whenever the sheet is carried in.

[Explanation of the Saddle Stitching Stapler]

Next, the saddle stitching stapler 40 positioned above the stacker section 35 is comprised of a driver unit 41 for driving a staple in a bunch of sheets, and a clincher unit 42 for bending leg portions of the driven staple in mutually opposed direction, and the units are configured in positions opposed to each other with the stacker section 35 therebetween, and bind sheets in a binding position shown by X in the figure that is a half the normal sheet length.

In addition, in addition to using a metal needle as a staple to bind a bunch of sheets, the saddle stitching stapler 40 may use a paper needle made of paper, or may provide sheets with a crimp or cut without using a needle to bind.

[Explanation of the Folding Rollers]

A configuration of folding rollers 45 will be described next. In a folding position Y disposed on the downstream side of the saddle stitching stapler 40 as described above, as shown in FIG. 2, provided are the folding rollers 45 for folding a bunch of sheets, and a folding blade 46 to insert a bunch of sheets into a nip position of the folding rollers 45. Referring to FIGS. 3A to 3D, the folding rollers 45 are comprised of an upper press-contact roller 45*a* and lower press-contact roller 45*b* in press contact with each other, and the upper press-contact roller 45*a* and lower press-contact roller 45*b* are formed to be slightly longer than the width length of a substantially maximum size. The folding rollers 45 are biased in mutually press-contact directions by compression springs not shown. The pair of folding rollers 45 are formed of a material such as rubber rollers with a relatively large coefficient of friction.

In the press-contact position of the folding rollers 45, the folding blade 46 for entering toward this position is disposed to be able to move forward and backward. After a bunch of sheets is subjected to saddle stitching by the saddle stitching stapler 40, the folding blade 46 shifts so as to push the bound position into the folding rollers 45, and in coordination with the operation, the folding rollers 45 rotate while being in press contact, and thereby fold saddle-stitched sheets in two. During the process, the folding blade 46 returns to an original position, and prepares for carry-in of the next bunch of sheets. A shift position of the folding blade 46 is shown in FIG. 2 as the folding position Y, and this position coincides with the position X in which sheets are bound as a bunch by the binding needle.

Figure 3A:
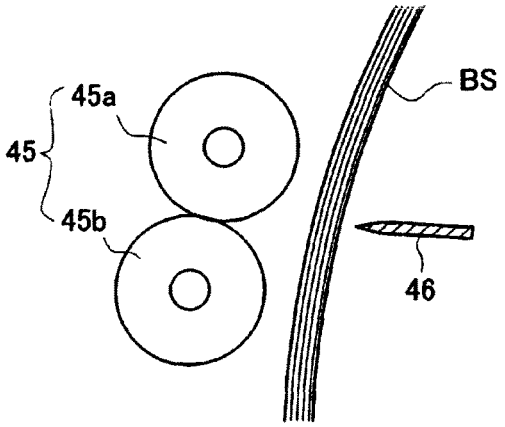
FIGS. 3A to 3D contain explanatory views of folding processing of folding rollers in the sheet processing apparatus.
Figure 3B:
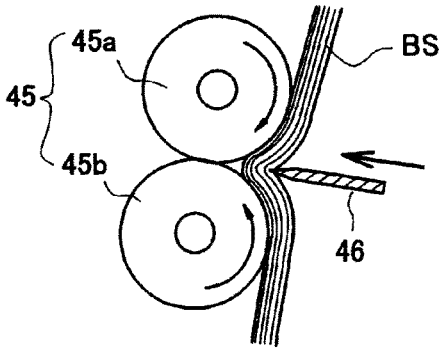

Referring to FIGS. 3A to 3D, described herein is a folding processing procedure of a bunch of sheets which are stacked or stacked and saddle-stitched. Sheets are locked by the stopper 38 to be a bunch, the stopper 38 moves up, and binding processing is performed in a position in the middle in the transport direction of sheets by the saddle stitching stapler 40. After the binding processing, at this point, a bunch of bound sheets is moved down, and the stopper 38 is halted so that the sheet bound position is the folding position. This state is illustrated in FIG. 3A. The stopper is halted so that this position coincides with the press-contact position of the upper press-contact roller 45*a* and lower press-contact roller 45*b* of the folding rollers 45. Subsequently, the upper press-contact roller 45*a* and lower press-contact roller 45*b* rotate in the same direction by a drive motor not shown, and the folding blade 46 shifts so as to push to the press-contact position. This state is illustrated in FIG. 3B.

Figure 3C:
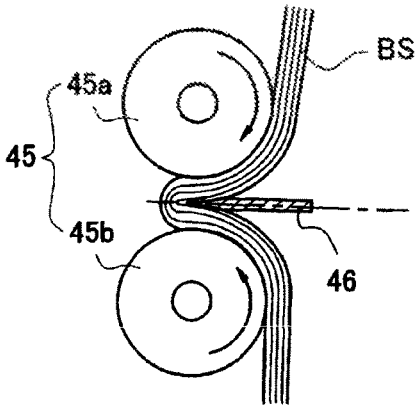
Figure 3D:
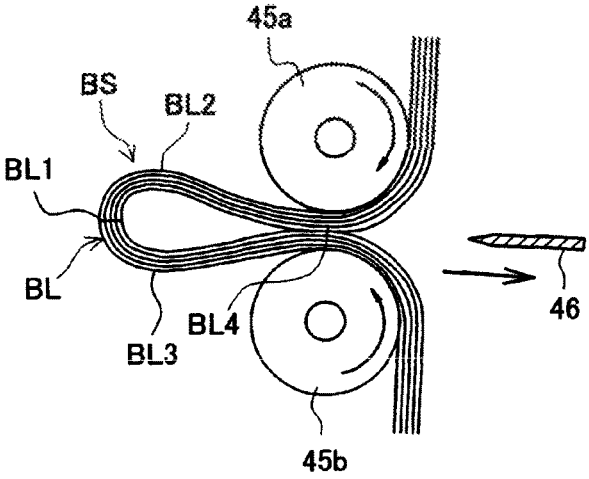

Next, as shown in FIG. 3C, successively, the upper press-contact roller 45*a* and lower press-contact roller 45*b* continuously rotate in the same direction, and the folding blade 46 is once halted before the press-contact position. At this point, the folding blade 46 shifts in an original return direction, and is retracted. Subsequently, when the upper press-contact roller 45*a* and lower press-contact roller 45*b* further rotate continuously in the same direction, as shown in FIG. 3D, a bunch of folding sheets BS is subjected to folding processing, while drawing a certain loop BL. In the bunch of sheets are formed a folded loop front end BL1 that is a fold struck by the folding blade 46, upper loop BL2 bulged upward with BL1 as the center, lower loop BL3 bulged downward, and loop base end portion BL4 for pressing the sheet so as to maintain the loop, and the rollers are once halted in this state.

In addition, the reason why the loop occurs in the fold is that forces such that a bunch of sheets itself opens outward work in the fold position. Accordingly, as the number of sheets of a bunch of folding sheets BS increases, the force to open is stronger, and the bunch of sheets is open in discharging without modification. Therefore, the apparatus in the present invention performs step-folding for pressing the loop portion sequentially with press rollers 70 stepwise to fold as described below.

[Explanation of the Folding Unit]

Figure 4:
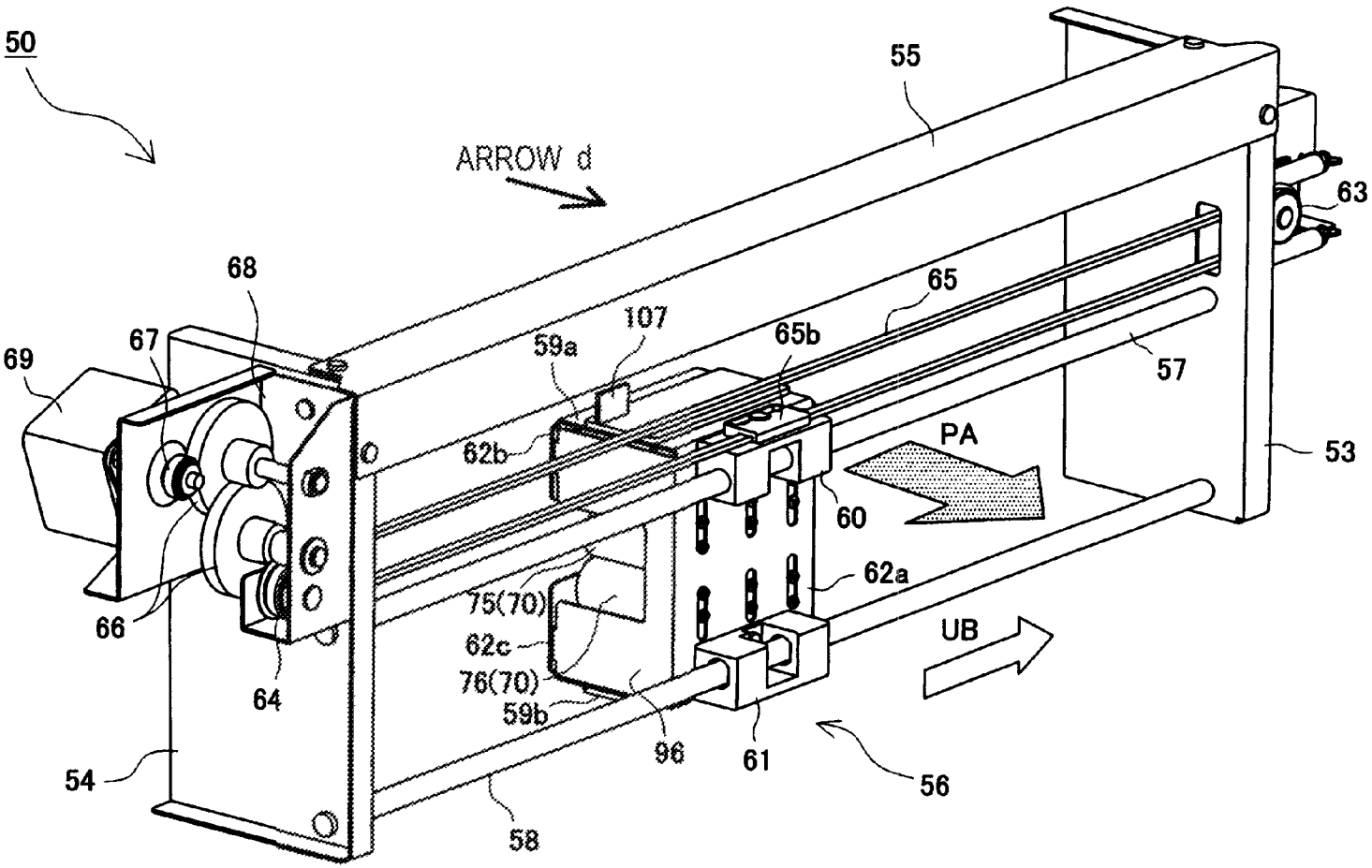
FIG. 4 is a perspective view of a shift mechanism of a support unit that supports press rollers, viewed from the bunch discharge outlet side.
Figure 5:
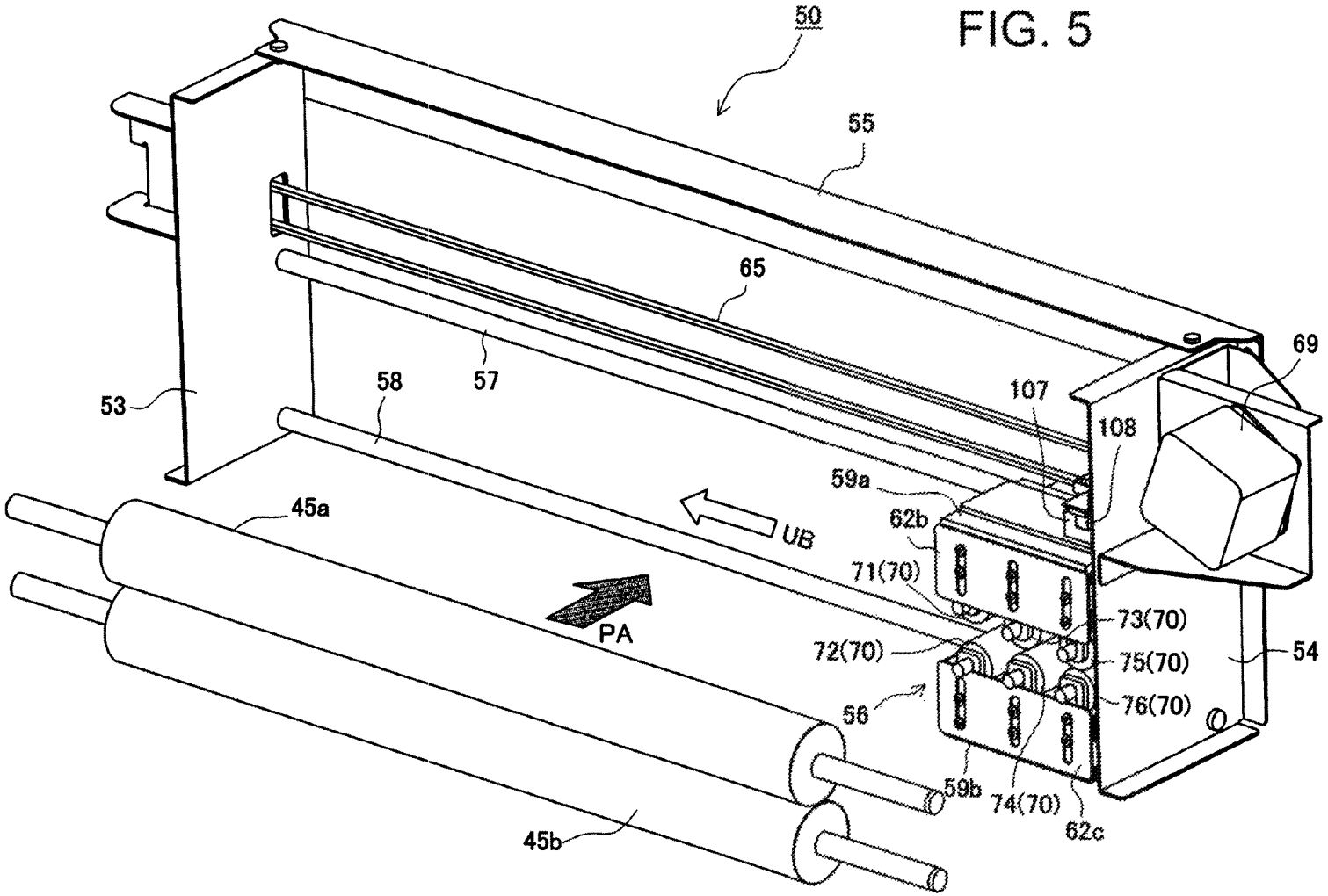
FIG. 5 is a perspective view of the folding unit, looking at the folding unit in FIG. 4 in the arrow d from the folding roller side.

Hereinafter, described is the folding unit 50 that is a part of the sheet processing apparatus according to the present invention to prevent a bunch of folding sheets BS subjected to the above-mentioned folding processing from being open. FIG. 4 is a perspective view of looking at the unit from the discharge side. FIG. 5 is a perspective view, looking from the folding roller 45 side shown by the arrow d in FIG. 4. Further, with respect to a support unit 56 that shifts along the folded loop in the folded sheet width direction inside the folding unit 50, the unit 56 will be described with reference to FIG. 6 that is a perspective view from the folding roller 45 side, and FIG. 7 that is a front view. Subsequently, the relationship will be described between a guide plate 201 positioned between press rollers 70 and the press roller 70 with reference to FIGS. 8 to 10B, and step-folding operation will be described with reference to FIGS. 11 to 14C.

First, returning to FIG. 2, the folding unit 50 is disposed so as to cross a folding sheet transport path BP on the downstream side of the folding rollers 45. More specifically, the folding unit 50 presses a bunch of sheets in a folded state such that the folding rollers 45 fold the bunch of folding sheets BS, with press rollers 70 that are press rollers with different distances, and thereby performs folding processing. The folding unit 50 faces the fold of the bunch of folding sheets BS that has the fold in the sheet width direction and that has a certain loop.

Further, at the front and back of the folding unit 50 of FIG. 2 are disposed a bunch carry-in detection sensor (SEN3) 129 that detects the back and fore edges of folded sheets which are folded with the folding rollers 45 and are transported, and a bunch discharge sensor (SEN4) 131 that detects discharge from bunch discharge rollers 49, respectively.

In addition, the folding unit 50 of FIG. 2 is disposed between the folding roller 45 and the bunch discharge rollers 49 as a discharge member to discharge outside the apparatus, and by crossing the folding sheet transport path BP, it is also possible to install on the downstream side of the bunch discharge rollers 49.

As shown in FIG. 4, the folding unit 50 constitutes frames of the entire apparatus, with a right side plate 53 disposed on one side of the apparatus, left side plate 54 opposed to the plate 53, and a coupling angle 55 that couples the plates above the plates. Between the right side plate 53 and the left side plate 54 is disposed the support unit 56 that is a unit for shifting, while supporting a plurality of rows of press roller 70 that reciprocates and shifts between the side plates. This reciprocating shift between the side plates of the support unit 56 is made by sliding along an upper guide rail 57 positioned above and lower guide rail 58 between the right side plate 53 and the left side plate 54. In other words, the unit is supported to be able to shift so that an upper slide block 60 attached to an upper portion of the support unit 56 slides on the upper guide rail 57, and that a lower slide block 61 attached to a lower portion of the support unit 56 slides on the lower guide plate 58.

Further, above the support unit 56, a shift belt 65 extends between the right side plate 53 and the left side plate 54 of the apparatus. As shown in FIG. 4, a right pulley 63 is positioned on the right side plate 53 side, a left pulley 64 is positioned on the left side plate 54 side, and the shift belt 65 is wound between the pulleys. Then, one end of the shift belt 65 is fixed to a belt fix portion 65*b* on the top end of the support unit 56. Accordingly, when the shift belt 65 is shifted and shifts the belt fix portion 65*b* from the apparatus front (left side) to the back side (right side), the support unit 56 also shifts from the apparatus front (left side) to the back side (right side) of FIG. 4 along the upper guide rail 57 and the lower guide rail 58. When the shift belt 65 is shifted in the opposite direction, the belt fix portion 65*b* shifts also in the opposite direction, and the support unit 56 also shifts in the opposite direction.

In addition, in this mechanism, in the direction for pressing the folded loop stepwise while shifting in the direction in which press roller 70 pairs of a plurality of rows, described later, are wide to narrow, it is assumed that the side from which the unit shifts at this point is the downstream side, and that the side to which the unit shift has shifted is the upstream side. In other words, in a shift direction from the left to the right (direction of the arrow UB) of FIG. 4, it is assumed that the right side is the downstream side, and that the left side is the upstream side.

In addition, to the left pulley 64 around which the shift belt 65 is wound is attached a motor gear unit 68 provided in the left side plate 54 with a forward/backward rotation-capable unit drive motor 69. Rotation drive of the unit drive motor 69 is coupled to the left pulley 64 of the shift belt 65 from a motor output gear 67 via a transmission gear 66 provided in the motor gear unit 68.

Accordingly, by selection of the drive rotation direction of the unit drive motor 69, the support unit 56 is also capable of selectively shifting so that the unit shifts from the apparatus front side (left side) to the back side (right side) to press the folded loop, and inversely returns from the back side (right side) to the front side (left side). In addition, as shown in FIG. 5, near the upper end portion of the left plate 54 side (right side in FIG. 5) of the support unit 56, a unit flag 107 is provided to indicate being in a home position (HP) positioned close to the left side plate 54. When the unit flag 107 is detected by a home position sensor 108, the support unit 56 is positioned in the home position (HP). The unit shifts from this position to the white arrow UB of FIG. 5 to stepwise press the folded loop.

Then, when the support unit 56 shifts from the home position (HP) in the arrow UB direction, the position is determined by a pulse generator, not shown, incorporated into the unit drive motor 69, and it is determined that the unit is positioned in a return position close to the right side plate 53. In the return position, the unit drive motor 69 is rotated backward to control so that the support unit 56 next shifts toward the home position (HP). Accordingly, the shift unit 56 is a unit shift member that is shifted by the shift belt 65 and the like.

[Configuration of the Shift Unit]

Described next is a configuration of the support unit 56 that shifts from side to side shown in the figure. FIG. 5 is a view viewed from the folding roller 45 side, and the support unit 56 is enclosed with a unit base plate 62*a* (FIG. 4) constituting the rear side of the unit, front upper base plate 62*b* and front lower base plate 62*c* that are divided vertically, prior unit side plate 95 and subsequent unit plate 96 on the sides thereof, and a unit top plate 59*a* and unit bottom plate 59*b* on the upper and lower portions thereof.

Figure 6:
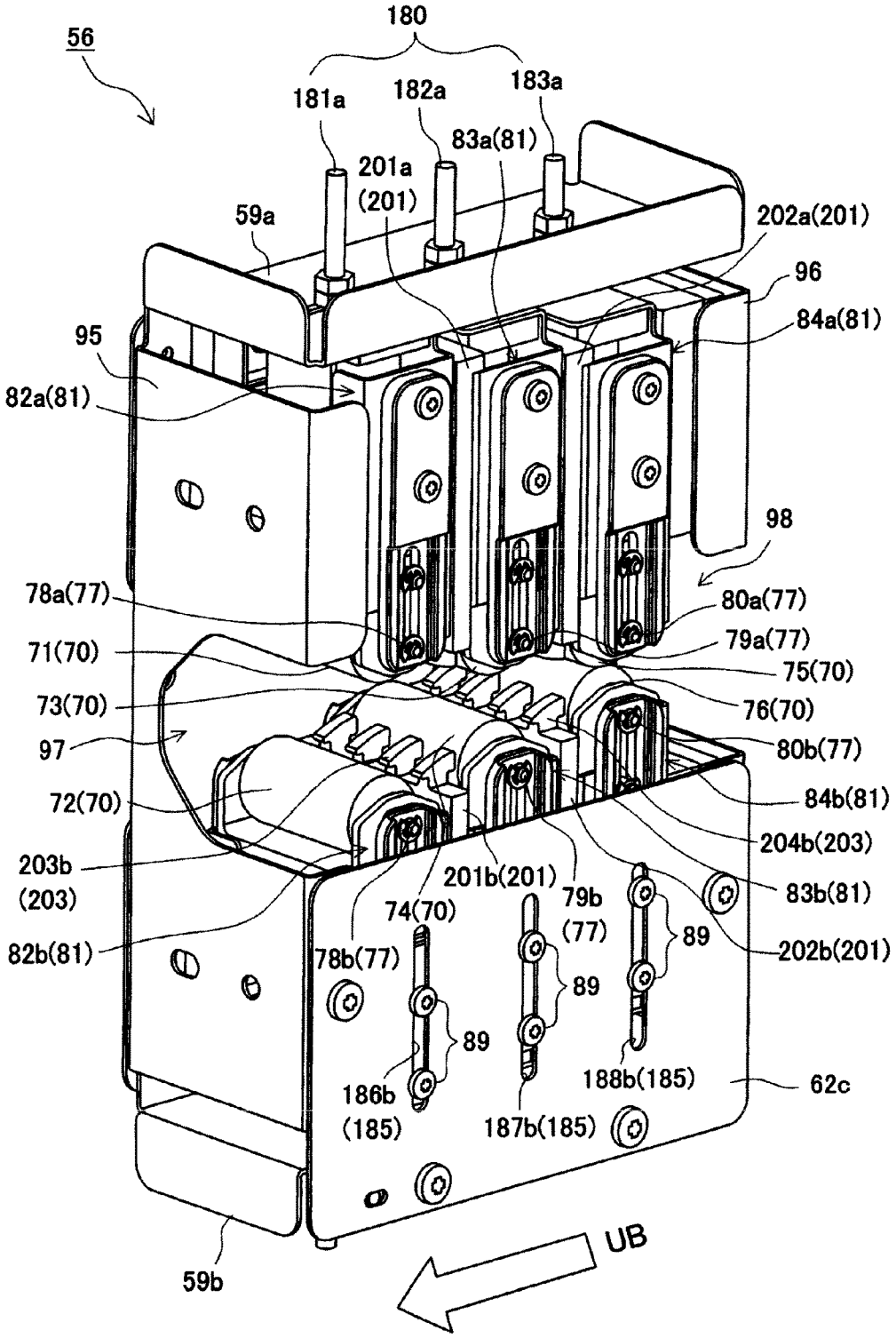
FIG. 6 is a perspective view of the support unit that supports press roller units shifting inside the folding unit of FIG. 4, viewed from the folding roller side.

As shown in FIG. 6, the prior unit side plate 95 is provided with a prior side plate opening 97 that is open relatively wide, and the subsequent unit side plate is provided with a subsequent side plate opening 98 set to be narrower than the prior side plate opening 97. These openings are provided so that the support unit 56 shifts, while nipping the fold of sheets, and pressing of the folded loop BL is started from the prior side plate opening 97 side.

The inside of the support unit 56 will be described with reference to FIGS. 6 and 8, and for convenience in description, the front upper base 62*a* is omitted. First, press roller (the press roller is collectively shown by reference numeral 70) pairs comprised of a plurality of rows, in this Embodiment, three rows are provided from the prior unit side plate 95 side to the subsequent unit side plate 96. In these press rollers 70, a distance between paired rollers (folded loop thickness direction) varies for each row. In other words, as rollers of the first row, a first upper press roller 71 and first lower press roller 72 are disposed in positions spaced a predetermined distance in almost equally opposed positions with the sheet fold position as the center. These press rollers 70 are configured as a press roller unit 81, as described later, and the press roller unit supports the press rollers 70.

In the unit shown in the figure, a first upper press roller shaft 78*a* that is the shaft of the first upper press roller 71 is attached to a first upper press roller support arm 91*a* that supports the shaft, the first upper press roller support arm 91*a* is attached to a first upper press roller frame 86*a* made of a mold member subjected to bending processing with a sheet metal to be hollow, and the unit is thereby made.

Further, between the first upper press roller 71 and the top of the first upper press roller frame 86*a* is disposed a first upper press roller pressing spring 147*a* that biases the first upper press roller 71 in a direction (downward direction of FIG. 8) for always pressing the folded loop. Further, the first upper press roller support arm 91*a* is provided with a support arm long hole 94. Accordingly, the first upper press roller shaft 78*a* is capable of shifting in this range, and when being attached to the support unit 56, the support arm long hole 94 regulates a shift of the first upper press roller 71.

Further, as in the foregoing, in the first lower press roller 72 in the opposite position with the folded loop BL of folding sheets therebetween, a first lower press roller shaft 78*b* that is the shaft of the first lower press roller 72 is also attached to a first lower press roller support arm 91*b* that supports the shaft. The first lower press roller support arm 91*b* is also attached to a first lower press roller frame 86*b* made of a mold member subjected to bending processing with a sheet metal to be hollow, and the unit is thereby made. Further, similarly, between the first lower press roller 72 and the top of the first lower press roller frame 86*b* is disposed a first lower press roller pressing spring 147*b* that biases the first lower press roller 72 in a direction (upward direction of FIG. 8) for always pressing the folded loop.

Furthermore, the first lower press roller support arm 91*b* is provided with a support arm long hole 94. Accordingly, the first lower press roller shaft 78*b* is capable of shifting in this range, and when being attached to the support unit 56, the support arm long hole 94 regulates an upward shift of the first lower press roller 72.

Still furthermore, with respect to a second upper press roller unit 83*a* that supports a second upper press roller 73 of the second row, a second lower press roller unit 83*b* that supports a second lower press roller 74, a third upper press roller unit 84*a* that supports a third upper press roller 75 of the third row, and a third lower press roller unit 84*b* that supports a third lower press roller 76, as in the first row, units are configured to be opposed to respective units.

Accordingly, each of the press rollers 70 is supported by a press roller support arm 90, and is beforehand assembled as the press roller unit 81 together with the press roller pressing spring 146 to be the unit, and it is possible to perform incorporation of the press roller unit 81 into the support unit 56 with ease. In addition, the unit configuration of the press roller 70 will be described again with reference to FIGS. 9A and 9B.

[Relationship Among Press Rollers in the Support Unit]

Figure 7:
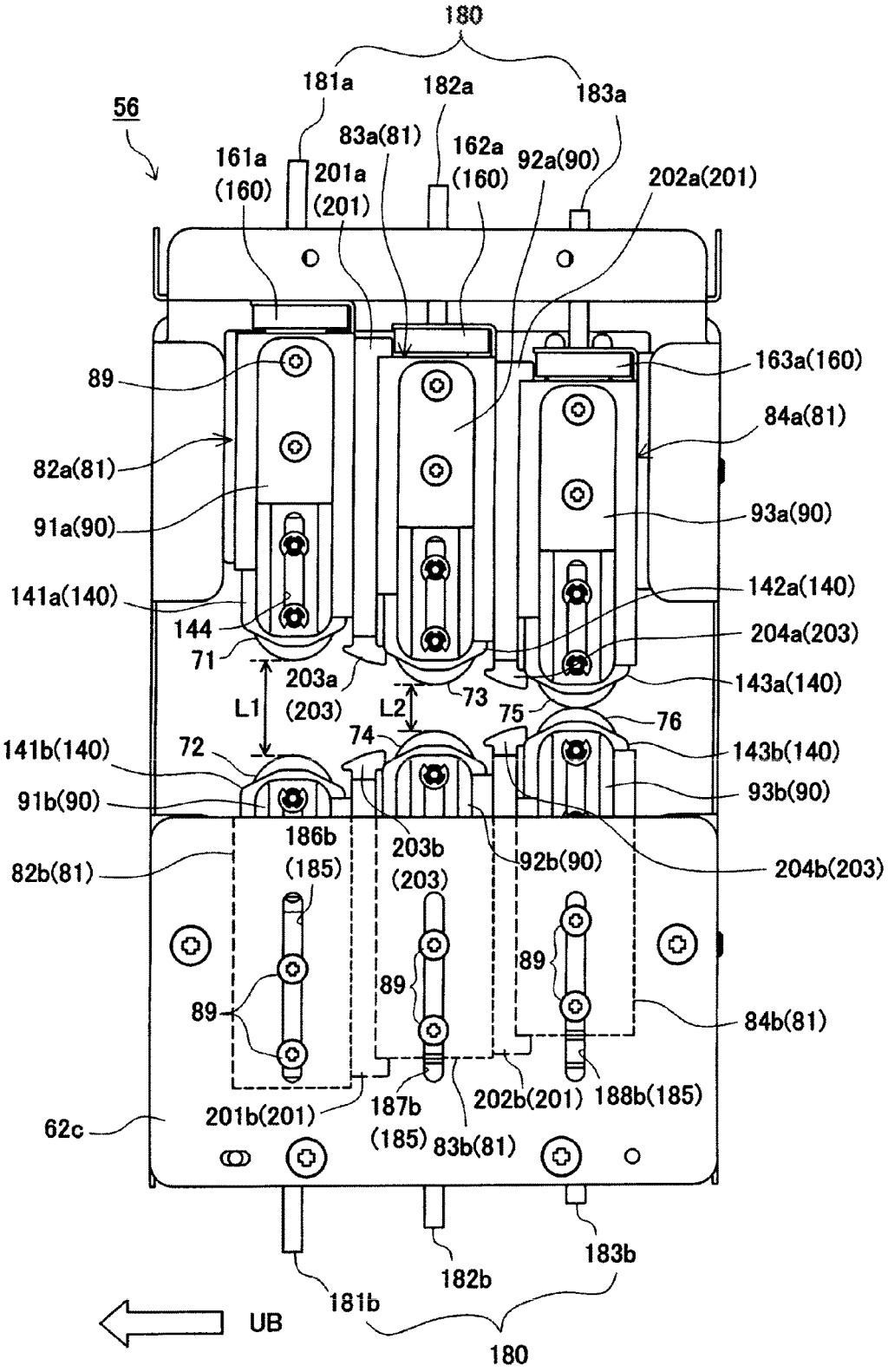
FIG. 7 is a front view, from the folding roller side, of a state in which a front upper base plate of the support unit of FIG. 6 is removed.

Described next is the relationship among press rollers 70 in the support unit. As shown in FIG. 7 well, a roller distance L1 between the first upper press roller 71 and the first lower press roller 72 is always kept constant. In this Embodiment, L1 is set at approximately 14 mm. Further, each of the first upper press roller pressing spring 147*a* and first lower press roller pressing spring 147*b* shown in FIG. 8 is set to impose a load of approximately 4.0 kg in a state in which both of the rollers contact.

Further, as shown in FIG. 7 well, a roller distance L2 between the second upper press roller 73 and the second lower press roller 74 is also always kept constant. In this Embodiment, L2 is set at approximately 7 mm. Furthermore, each of second upper press roller pressing spring 148*a* and second lower press roller pressing spring 148*b* shown in FIG. 8 is set to impose a load of approximately 4.0 kg in a state in which both of the rollers contact.

As described above, the first upper press roller 71 and first lower press roller 72 of the first row are spaced the predetermined distance L1 (approximately 14 mm in this Embodiment) apart from each other, and similarly, the second upper press roller 73 and second lower press roller 74 of the second row are spaced the predetermined distance L2 (approximately 7 mm in this Embodiment) apart from each other. By this means, the shift range is regulated by the support arm long hole of the press roller support arm 90 that supports each press roller 70, while setting attachment positions to the support unit of the press roller units 81 of the first and second rows. Accordingly, the press rollers 70 of the first and second rows are regulated in positions not to be narrower more than the predetermined distance.

However, as shown in FIGS. 6 to 9B, with respect to the third upper press roller 75 and third lower press roller 76 of the third row as the last row in this Embodiment, the rollers are elastically biased to be capable of being always in press contact. For this manner, a position of the press roller unit 81 of the third row is specified so that roller distance L3=0. In addition, in this Embodiment, each of third upper press roller pressing spring 149*a* and third lower press roller pressing spring 149*b* is also set to impose a load of approximately 4.0 kg in a roller contact position. By this means, while imposing the load exceeding 4 kg on opposite sides of the folded loop (fold BL1 of the loop front end) of a bunch of folding sheets BS, the press rollers 70 perform step-folding for sequentially pressing the folded loop. Accordingly, each of the press rollers 70 is biased in the direction for pressing the sheets. Operation of this step-folding will be described later with reference to FIGS. 11 to 13.

[Explanation of Guide Plates]

Figure 8:
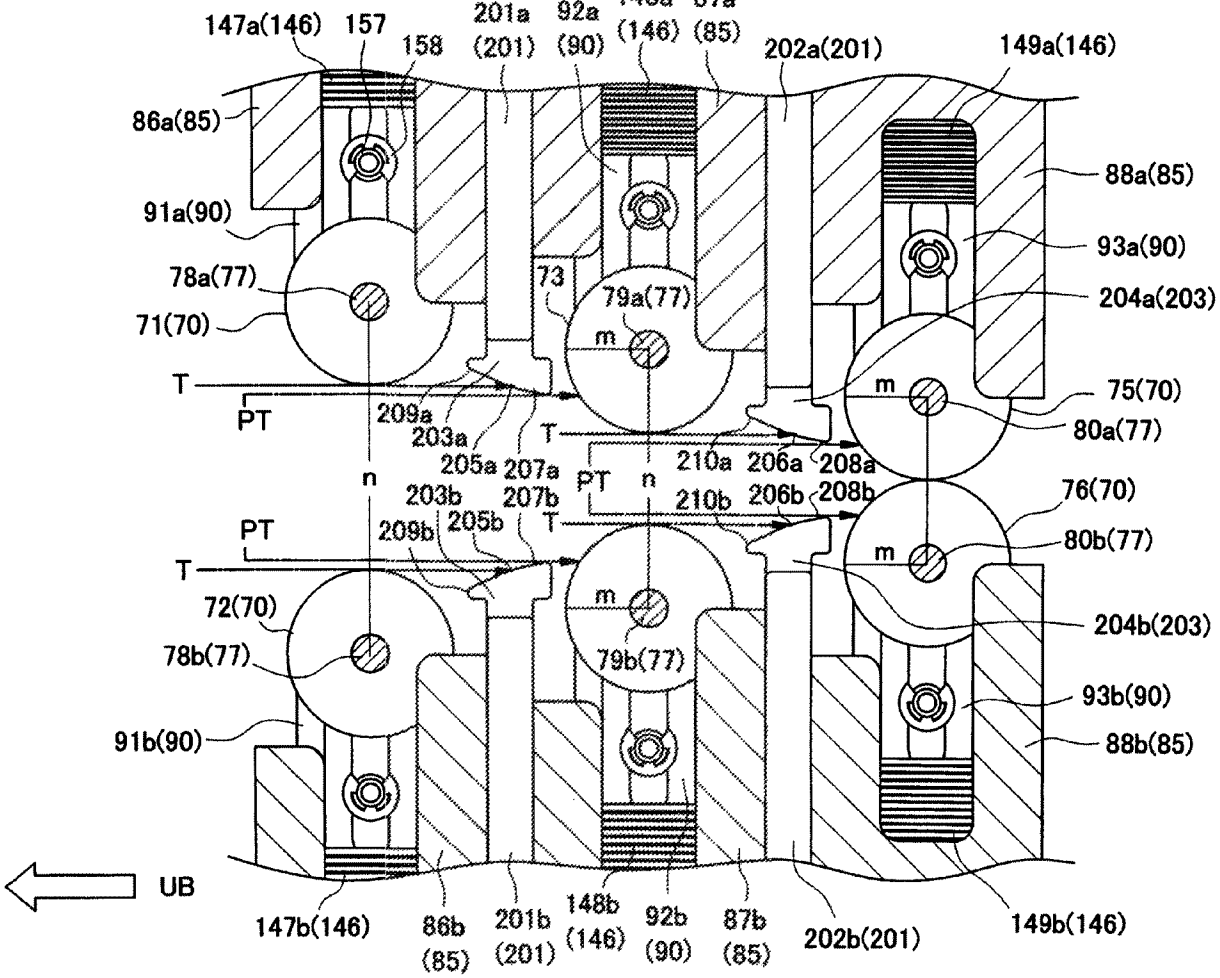
FIG. 8 is an enlarged view of the vicinity of the press rollers and guide plates of FIG. 7.

Referring to FIGS. 6 to 8, described herein are guide plates 201 disposed between respective press rollers 70 to guide the folded loop. As shown in the figures, a first upper guide plate 201*a* is disposed between the first upper press roller 71 of the first row and the second upper press roller 73 of the second row, and a second upper guide plate 202*a* is disposed between the second upper press roller 73 and the third upper press roller 75 of the third row. Further, a first lower guide plate 201*b* is disposed between the first lower press roller 72 of the first row and the second lower press roller 74 of the second row in positions opposed to the plate with the folded loop therebetween, and a second lower guide plate 202*b* is disposed between the second lower press roller 74 and the third lower press roller 76 of the third row.

Each of the guide plates 201 has a guide portion 203 of which the front end extends to the periphery of each press roller 70, and the base end portion side is attached to the press roller unit 81. Although explanation of structure of this attachment will be given in FIGS. 9A and 9B, the guide portion 203 is positioned corresponding to the distance between opposed press rollers 70 when the press roller 70 shifts by the shift (shift in the arrow UB direction in FIG. 8) of the shift unit 56, and the press rollers 70 and guide portions 203 of the guide plates 201 constitute the shape of cross section of a funnel (isosceles triangle with the rollers of the third row as the vertex), and thereby prevent the end portions of the folded loop from being entangled between respective press rollers 70.

Described next is the position relationship between the press roller 70 and the guide portion 203 formed on the front end side of the guide plate 201, particularly with reference to FIG. 8. As shown in the figure, four guide plates 201 are arranged as two pairs in the upper and lower portions. Among the plates, described is the first upper guide plate 201*a* disposed between the first upper press roller 71 and the second upper press roller 73. The front end of the first guide plate 201*a* bulges, and forms the first upper guide portion 203*a* which is bulged and extended from the first upper guide protruding portion (convex portion) 211*a* side positioned between the first upper press roller 71 and the second upper press roller 73. The first upper guide portion 203*a* has a first upper guide slope portion 205*a* sloped downward, as viewed in the figure, from a first upper guide downstream portion 209*a* on the first upper press roller 71 (downstream) side toward the second upper press roller 73 (upstream) side. The extension and slope is provided to prevent the end portion of the folded loop BL from being entangled and/or caught in between the first upper press roller 71 and the second upper press roller 73.

As the relationship among the first upper press roller 71, second upper press roller 73 and first upper guide portion, with respect to the normal n passing through the first upper press roller shaft 78*a* that is the center axis of the first upper press roller 71 on the downstream in a direction substantially orthogonal to the support unit 56 shift direction of the first upper press roller 71 on the downstream side of the first upper guide slope portion 205*a*, the tangent T forming approximately a right angle with the normal n on the periphery of the first upper press roller 71 on the downstream side is disposed in the relationship of crossing (relationship that the arrow of T is brought into contact with) the first guide slope portion 205*a*. In addition, it is essential only that the tangent T in this case is within a range of guiding the folded loop BL end portion.

Further, the relationship between the first upper guide slope portion 205*a* and the second upper press roller 73 positioned on the upstream side thereof is a relationship (relationship that the arrow PT is brought into contact and relationship of being positioned substantially in the range lower left one-fourth the periphery of the second upper press roller 73 as viewed in FIG. 8) in which a first upper guide upstream portion 207*a* corresponds to the range of the periphery of the second upper press roller 73 on the upstream side of the first upper guide slope portion 205*a*, which is enclosed with a straight line m along the shift direction of the support unit 56 passing through a second upper press roller shaft 79*a* that is the center axis of the second upper press roller 73, and the normal n forming approximately a right angle with the straight line m.

By providing the above-mentioned relationships, by this means, the guide portion 203 extends in the shift direction of the support unit 56, peripheries of front and back press rollers 70 are exposed, the folded loop is guided in the shape of cross section of a funnel (the shape of an approximately isosceles triangle that the downstream side is the base and that the upstream side is the vertex) as a whole, and it is possible to perform stepwise folding relatively smoothly.

[Attachment of the Guide Plate to the Press Roller Unit]

Figure 9B:
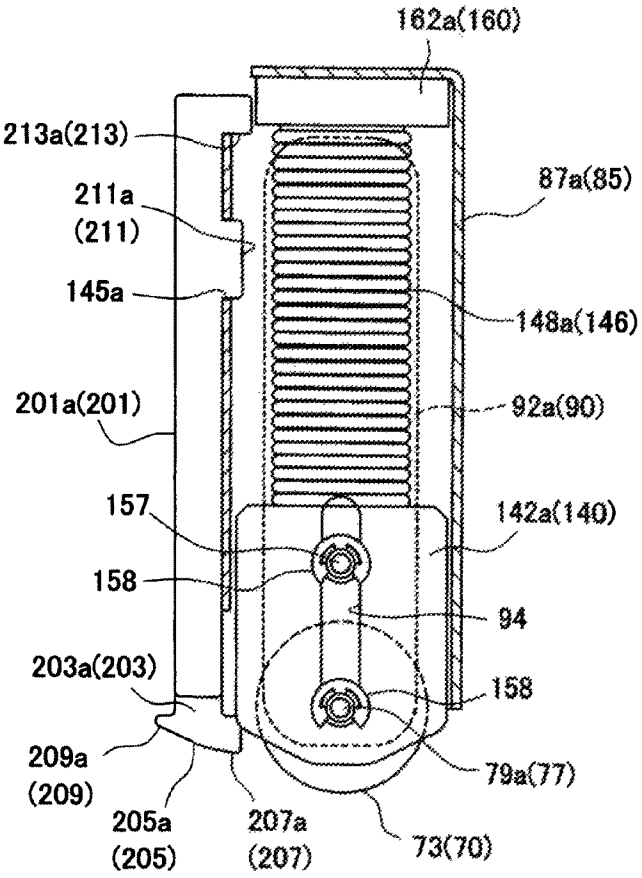
FIGS. 9A and 9B contain views to explain the press roller unit supported by the support unit and the guide plate attached thereto shown in FIGS. 6 and 7, where
Figure 9A:
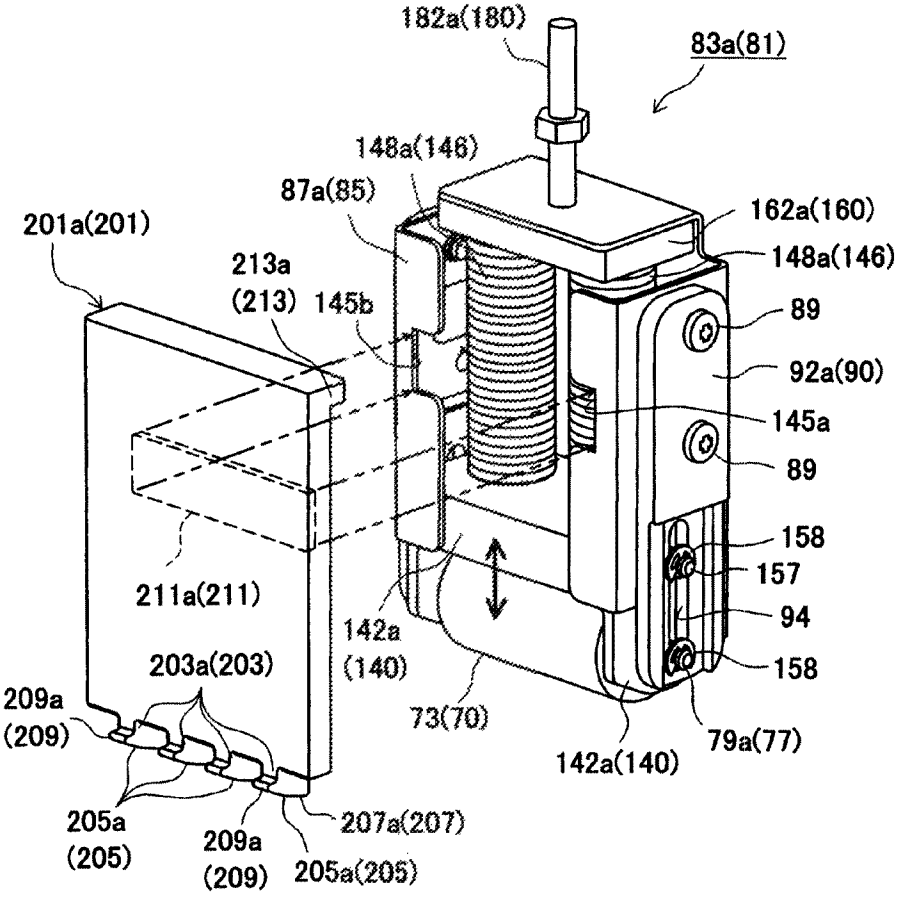
Figure 10B:
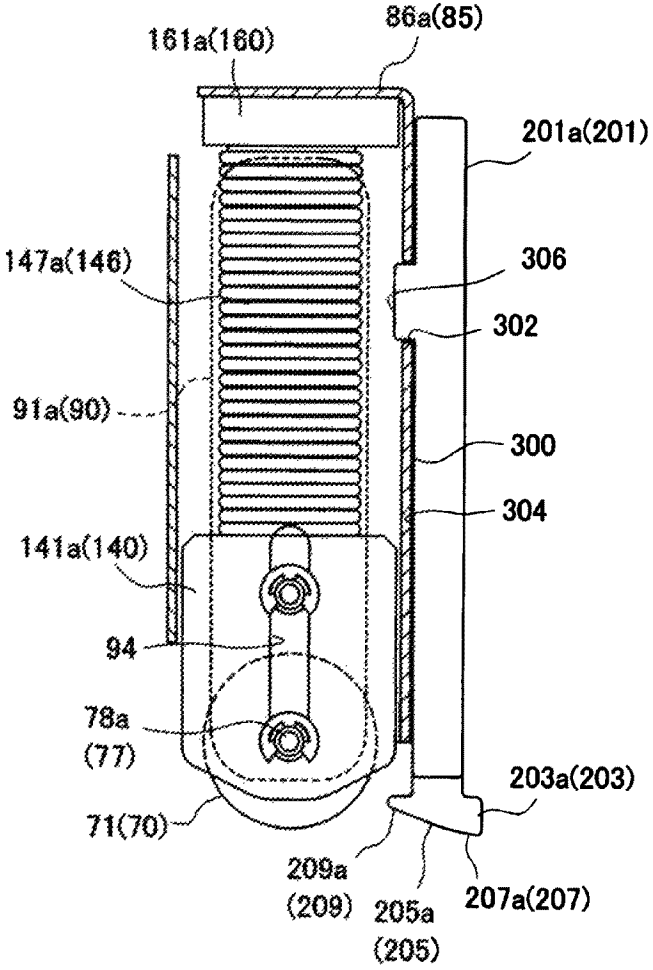
FIGS. 10A and 10B show another Embodiment illustrating positioning of the press roller unit and guide plate, where
Figure 10A:
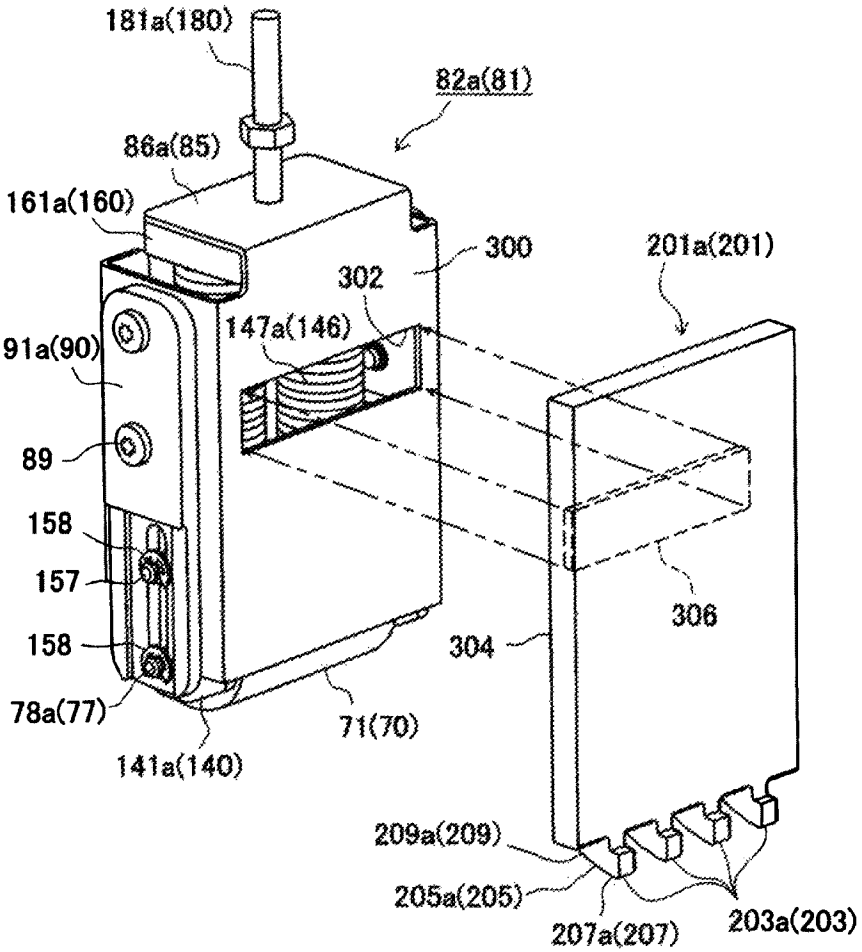

In this Embodiment, since the guide portion of the guide plate 201 is set for the above-mentioned relationship with each press roller 70, accurate mutual positioning is required. Therefore, an attachment configuration is included as shown in FIGS. 9A and 9B. FIG. 9A is a perspective view where the guide plate is positioned in the second upper press roller unit guide. FIG. 9B is a cross-sectional explanatory view of the perspective view. FIGS. 10A and 10B illustrate a Modification of the attachment configuration of FIGS. 9A and 9B. The figures will be described below.

As described slightly previously, the description of the second upper press roller unit 83*a* will be added first. As shown in FIG. 9A, the second upper press roller unit 83*a* has the second upper press roller 73 rotatable to press the folded loop BL, and a second upper press roller frame 87*a* (frame) which holds a second upper press roller bracket 142*a* for supporting the second upper press roller 73 slidably by the inner wall thereof.

Between the second upper press roller frame 87*a* and the second upper press roller bracket 142*a*, as shown in the figure, two second upper press roller pressing springs 148*a* (elastic springs) for biasing the second upper press roller 73 in the sheet pressing direction are attached on the right and left via a second upper press roller receiver 162*a*.

Further, to the right and left faces of the second upper press roller frame 87*a* shown in the figure are attached second upper press roller support arms 92*a* that support the second upper press roller shaft 79*a* of the second upper press roller 73 to be movable in the support arm long hole 94. As attachment of the second upper press roller support arm 92*a*, the arm is locked in an opening provided on the side portion of the second upper press roller frame 87*a* by an arm hook 92*af* fitted into the opening. On the other hand, to the support arm long hole 94 of the second upper press roller support arm 92*a* is attached also a roller bracket shaft 157 installed fixedly in the second upper press roller bracket to be movable by an E ring 158. By these members, the second upper press roller unit 83*a* is configured as a unit.

Accordingly, as shown in FIG. 9A, since the second upper press roller support arm 92*a* is locked by the arm hook 92*af* to make the unit, in this state, it is possible to easily attach to the support unit 56 with assemble screws 89. This configuration is the same in all press roller units 81 in FIGS. 6 to 8. Further, in the second upper press roller unit 83*a*, so as to enable a position adjustment to be made with respect to the support unit 56, a second upper press roller unit adjustment screw 182*a* is attached to a top portion of the unit 83*a*.

By the means as described above, it is made possible to attach the second upper press roller unit 83*a*, which includes the second upper press roller 73, second upper press roller pressing springs 148*a* for biasing the roller and the like as a unit, to the support unit 56, and assembly is thereby made ease. Further, the second upper press roller unit 83*a* is provided with the second upper press roller unit adjustment screw 182 to enable vertical adjustments to be made with respect to the support unit 56. By this means, it is possible to set the most suitable position to press the folded loop BL.

Described next is an attachment configuration of the first upper guide plate 201*a*, which is positioned on the downstream side in the shift direction of the support unit 56, to the second upper press roller unit 83*a*.

As shown in the perspective view of FIG. 9A, on the outer wall on the upstream side of the second upper press roller frame 87*a* of the second upper press roller unit 83*a* are provided a frame cut portion right 145*a* and frame cut portion left 145*b* obtained by cutting portions of the frame as shown in the figure. With respect to the cuts, on the second upper press roller unit 83*a* side face (downstream side face/back side) of the first upper guide plate 201*a*, the first upper guide protruding portion (convex portion) 211*a* protruding toward the second upper press roller unit 83*a* is formed on the attachment portion side above the first upper guide portion 203*a*. Further, as shown in the cross-sectional explanatory view of FIG. 9B well, in a top end portion on the side opposite to the first upper guide portion 203*a* of the first upper guide plate 201*a* is provided a guide lock portion 213*a* to be fitted into the top end portion of the second upper press roller unit 83*a*.

The first upper guide protruding portion (convex portion) 211*a* is fitted into each of the frame cut portion right 145*a* and frame cut portion left 145*b* obtained by cutting portions of the frame as shown in the figure, the guide lock portion 213*a* is fitted into the top end portion of the second upper press roller unit 83*a*, and it is thereby possible to set the position relationship between the second upper press roller 73 and the first upper guide plate 201*a* in unit assembly. According to this configuration, it is possible to set the position relationship between the first upper guide portion 203*a* of the upper guide plate 201*a* and the second upper press roller 73 with accuracy.

In addition, in the apparatus shown in the figure, attachment of the upper guide plate 201*a* is made by the concavo-convex relationship, while nipping by the second upper press roller unit 83*a* and the first upper press roller unit 82*a*, and it is thereby possible to attach with ease, without an attachment screw and the like particularly.

According to the above-mentioned configuration, it is possible to perform positioning of the first upper guide portion 203*a* of the first upper guide plate 201*a* and the second upper press roller 73 with accuracy.

These configurations are similarly configured also in each of the other guide plates 201 and the press roller unit 81 on the upstream side of the guide plate 201.

By this means, in arranging press roller 70 pairs of the folded loop as rows, it is possible to attach the guide plate 201, which prevents the sheet end portion from being caught in between front and back press rollers 70, with ease, while maintaining position accuracy, by fitting of the concave portion and convex portion.

A Modification of FIGS. 9A and 9B will be described next with reference to FIGS. 10A and 10B. In FIGS. 9A and 9B, the first upper guide plate 201*a* is attached to the second upper press roller unit 83*a* positioned on the upstream side thereof. In the apparatus shown in FIGS. 10A and 10B, the upper guide plate 201*a* is positioned and attached to the first upper press roller unit 82*a* positioned on the downstream side.

In addition, this Modification also has the same configuration as that in FIGS. 9A and 9B, in the respect that the first upper press roller support arm 91*a* for holding the first upper press roller 71 is to make the unit by an arm hook 91*af* engaging in the side portion cut of the first upper press roller frame 86*a* and the like.

The first upper press roller frame 86*a* of the first upper press roller unit 82*a* shown in FIGS. 10A and 10B is provided with an upstream-side cut portion 302 cut in the rectangle shape in a frame upstream side face 300. The upstream-side cut portion 302 is provided so that a downstream-side protruding portion (convex portion) 306 provided on the downstream side face of the first upper press roller unit 82*a* engages in the cut portion 302. According to this configuration, it is possible to set the position relationship between the first upper guide portion 203*a* of the upper guide plate 201*a* and the first upper press roller 71 with accuracy.

[Operation Explanation of the Support Unit]

Figure 11:
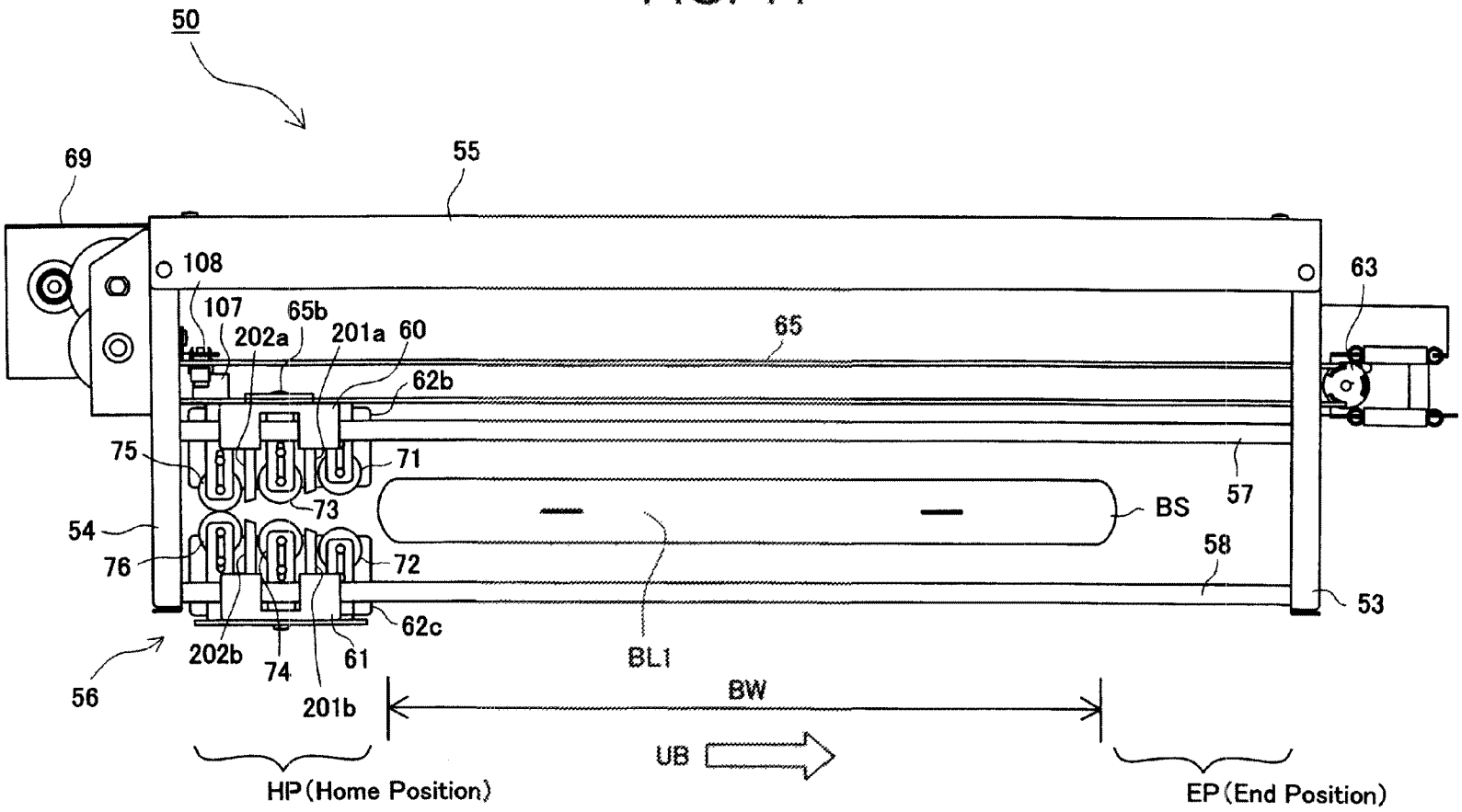
FIG. 11 is a front view of a state in which the support unit that supports the press roller shown in FIGS. 4 to 10B is in an initial position.
Figure 12:
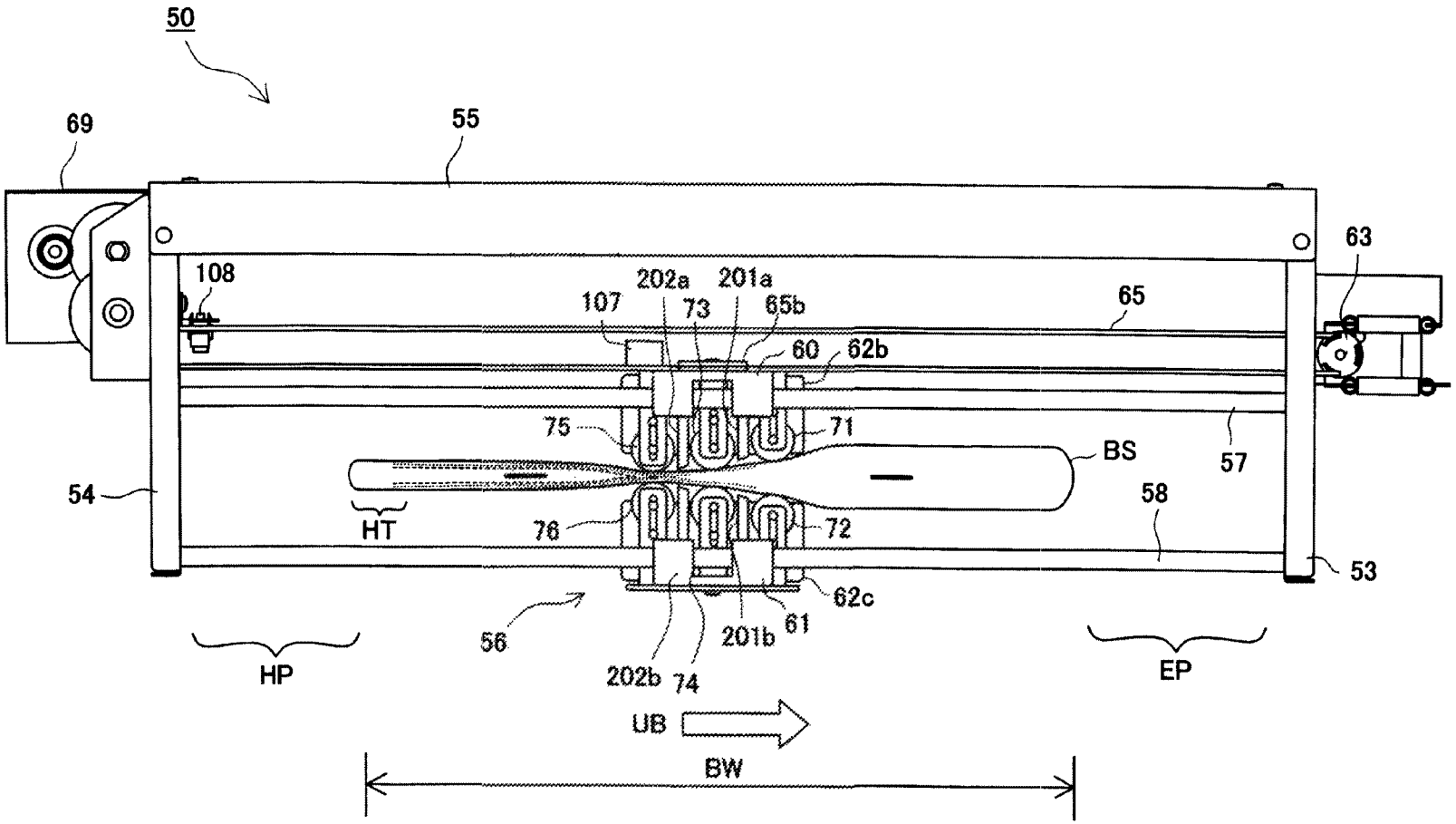
FIG. 12 is a front view of a state in which the support unit shown in FIGS. 4 to 10B shifts to the middle in the width direction.
Figure 13:
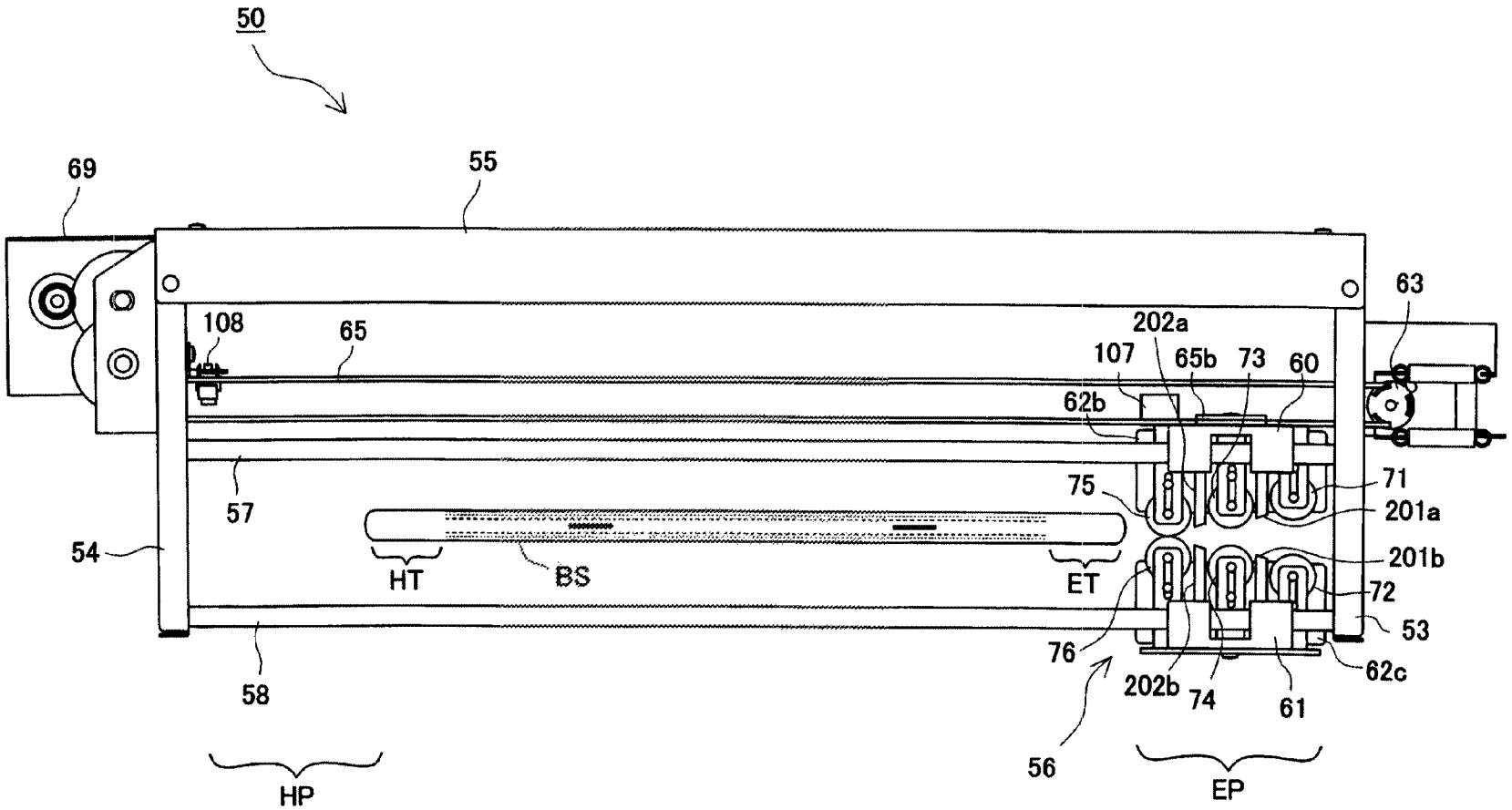
FIG. 13 is a front view of a finish state in the width direction of the support unit shown in FIGS. 4 to 10B.

Described hereinafter is carry-in of a bunch of folding sheets BS and stepwise pressing operation of the support unit 56 inside the folding unit 50, with reference to FIGS. 11 to 13. FIGS. 11 to 13 illustrate the support unit 56 viewed from the bunch discharge outlet side, and for convenience in description, the unit base plate 62*a* of the support unit 56 is omitted. FIG. 11 illustrates a state in which the support unit 56 is positioned in the home position (HP) to wait and prepare for carry-in of a bunch of folding sheets BS. FIG. 12 illustrates a state in which the support unit 56 shifts to the middle in the width direction of the bunch of folding sheets BS, and performs stepwise folding on a sheet bunch width BW of the folded loop BL by three rows of rollers. FIG. 13 illustrates a state in which stepwise step-folding by three rows of rollers is finished and the support unit 56 is positioned in an end position (EP) that is the return position. Each state will be described below.

First, in FIG. 11, the unit flag 107 of the support unit 56 having three rows of press rollers is detected by the home position sensor 108 attached to the right side plate 53, and the support unit 56 is positioned in the home position (HP). In this position, when a "step-folding mode" described later is set, the unit 56 waits for carry-in of a bunch of folding sheets BS which is subjected to folding processing by the folding rollers 45 and is transported in the folding sheet transport path BP.

In addition, the support unit 56 positioned in the home position (HP) is provided with the press rollers 70 in which the distance between rollers is narrower sequentially in the shift direction, and the last row is in press contact. As described already, in this Embodiment, the first upper press roller 71 and first lower press roller 72 of the first row are disposed with the distance of approximately 14 mm. Further, the second upper press roller 73 and second lower press roller 74 of the second row have the distance of approximately 7 mm. Furthermore, the third upper press roller 75 and third lower press roller 76 of the third row are in press contact with each other in a region R1. Still furthermore, the center of separation and press contact between respective rollers is disposed to substantially coincide with the folded loop front end (fold) BL1 of folded sheets that is the center of the bunch of folding sheets BS.

When the folded loop of the bunch of folding sheets BS is a predetermined size (in this Embodiment, for example, 22 mm in the vertical direction of the loop), the folding rollers 45 are halted, and the support unit 56 is shifted to the right in FIG. 11 by drive of the unit drive motor 69. When this shift starts, the first upper press roller 71 and first lower press roller 72 of the first row climb over the end portion (sheet end portion) on the left (one) side, as viewed in the figure, of the bunch of folding sheets, and shift to the right, while adding the fold in a slightly upward position from the folded sheet front end loop BL1. As described previously, since the size of the loop in this Embodiment is approximately about 22 mm, and the distance between the first upper press roller 71 and the first lower press roller 72 is approximately about 14 mm, weak overlapping of approximately 4 mm occurs vertically to add first fold lines 100 shown in FIG. 14A.

Further, since the distance between the first upper press roller 71 and the first lower press roller 72 is wide, the rollers climb over the end portion of the bunch of folding sheets BS with little damage thereto. Further, the press rollers 70 including the first upper press roller 71 and first lower press roller 72 are supported axially in the same direction as the sheet transport direction, and are supported to be rotatable on the axis. Also by this rotation, it is made ease climbing over the folded sheet bunch end portion.

Further, the first upper guide plate 201*a* and second upper guide plate 202*a* are disposed in the shift direction among the first upper press roller 71, second upper press roller 73 and third upper press roller 75. On the other hand, the first lower guide plate 201*b* and second lower guide plate 202*b* are disposed in the shift direction among the first lower press roller 72, second lower press roller 74 and third lower press roller 76 opposed to the upper rollers with the folded loop BL therebetween. By this means, the folded loop BL of the bunch of folding sheets BS is smoothly guided to between the press rollers 70 on the upstream side, without entering in between the rollers.

When the support unit 56 shifts successively, in the loop pressed by the distance between the first upper press roller 71 and the first lower press roller 72, the loop of the bunch of folding sheets BS is further pressed by the slightly narrower distance between the second upper press roller 73 and the second lower press roller 74, and is provided with second folds. In this Embodiment, further, the distance between the second upper press roller 73 and the second lower press roller 74 is set at approximately 7 mm, overlaps the distance between the first upper press roller 71 and the first lower press roller 72 by approximately about 3.5 mm in each of the upper and lower portions, and adds the second fold lines 101 shown in FIG. 14B.

Subsequently thereto, the fold BL1 is subjected to step-folding by the third upper press roller 75 and third lower press roller 76 that are rollers of the third row. In other words, the third upper press roller 75 and the third lower press roller 76 are set for the distance therebetween of "0", are in an substantially press contact state, perform step-folding on the sheets in the sheet width direction of the fold, while being pressed by the third upper press roller pressing spring 149*a* and third lower press roller pressing spring 149*b*, and add the last fold lines 102 shown in FIG. 14C.

FIG. 12 illustrates the state in which the bunch of folding sheets BS is pressed stepwise inside a single unit by the above-mentioned manner, and the support unit 56 is positioned in approximately the center in the sheet width direction of the bunch of folding sheets BS. From this state, further, the support unit 56 shifts to the right as viewed in the figure, while providing the sheets with fold lines stepwise in the fold thickness direction of the sheets by the press rollers 70 with the distance between respective rollers being narrower. By this shift, the third upper press roller 75 and third lower press roller 76 of the third row pass over the right/left (one) end portion (sheet end portion), as viewed in the figure, of the bunch of folding sheets, and the press rollers thus press sequentially to perform step-folding.

After passing, the support unit 56 reaches the end position (EP) that is the return position on the right side plate 53 side shown in the figure. This state is shown in FIG. 13. When the unit reaches the return position, drive of the unit drive motor 69 is halted. Subsequently, the unit waits for the bunch of folding sheets BS subjected to step-folding (with pressing by the press rollers 70 completed) to be discharged by rotation in the discharge direction of the folding rollers 45 and bunch discharge rollers 49. When completion of discharge of the bunch of folding sheets BS subjected to step-folding is detected by a bunch discharge sensor (SEN4) 131 shown in FIG. 2, the support unit 56 is returned from the return position to the home position (HP), and is prepared for carry-in of the next bunch of folding sheets BS in the position of FIG. 11.

In addition, in the foregoing, after once discharging the step-folded folding sheets BS of FIG. 13, the support unit 56 is returned from the end position (EP) to the home position (HP), and without discharging the bunch of folding sheets BS, by shifting the support unit 56 again from the right to the left in FIG. 13, and returning to the home position (HP), while pressing again the fold of the bunch of folding sheets BS by the third upper press roller 75 and the third lower press roller 76, it is also possible to make step-folding by the last row more reliable.

As described above, in this Embodiment, the support unit 56 executes folding of three steps on the bunch of folded folding sheets BS. The bunch of folding sheets BS which is subjected to this folding operation and discharged will be descried with reference to FIGS. 14A to 14C. As described previously, from the fold thickness direction (vertical direction crossing the transport direction of the bunch of folding sheets BS in the fold) of the bunch of folding sheets BS by the first upper press roller 71 and first lower press roller 72 as the press member of a bunch of sheets of the present invention, a plurality of folds is added by shifting portions, where the fold is made by the folding rollers 45 and the folded loop BL occurs, in the fold direction.

Figure 14A:
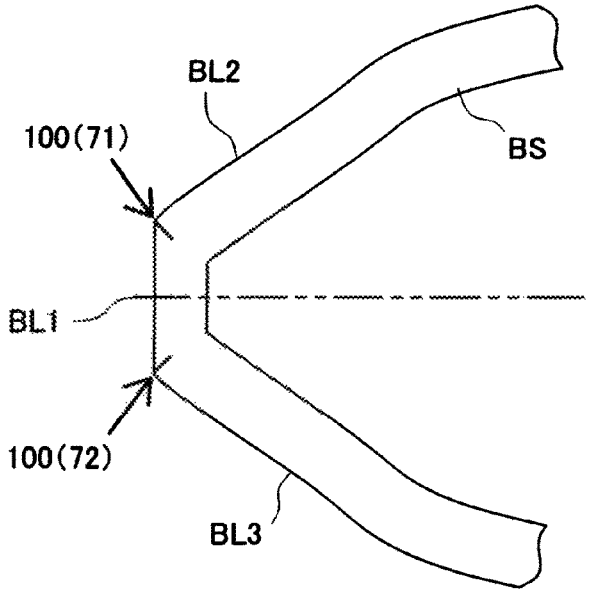
FIGS. 14A to 14C contain explanatory views of a sheet folded booklet with a plurality of folding lines formed by stepwise folding in FIGS. 11 to 13, where
Figure 15A:
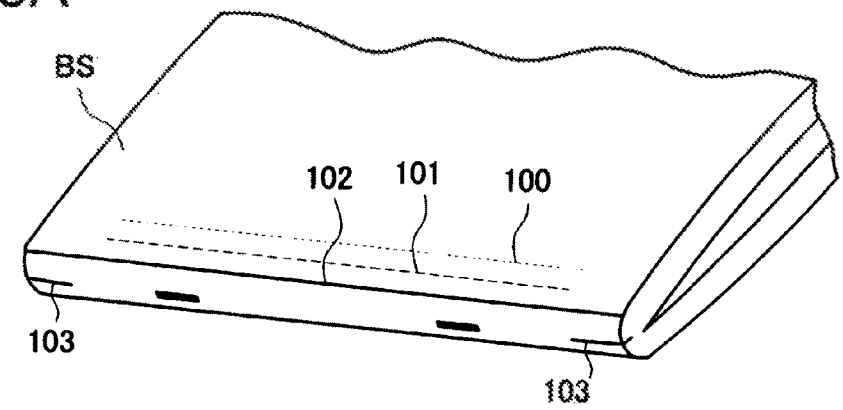
FIGS. 15A to 15C contain views illustrating the booklet pressed by the press rollers in FIGS. 14A to 14C, where

As described already, the distance between the first upper press roller 71 and the first lower press roller 72 of the first step is defined as a distance (in this Embodiment, approximately 14 mm with respect to a loop height of 22 mm) slightly narrower than the folded loop, and the rollers shift along the fold added by the folding rollers 45 to make the folds of the first step. The folds are the first fold lines 100 shown by the solid-line arrows of FIG. 14A, and in FIG. 15A, appear as the first fold line 100 by thin lines in the bunch of folding sheets BS. This is because portions pressed by the first upper press roller 71 and first lower press roller 72 undergo concentrated loads in the portion made the loop as shown in FIG. 14A, the bunch of sheets buckles and is folded, and the portions appear as the first fold line 100 by a shift of the first upper press roller 71 and first lower press roller 72 in the width direction.

Figure 14B:
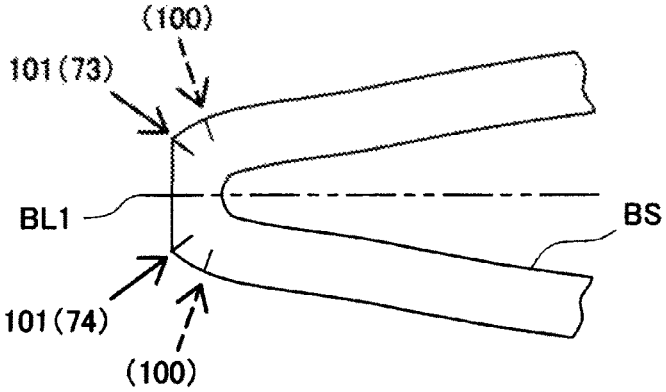
Figure 14C:
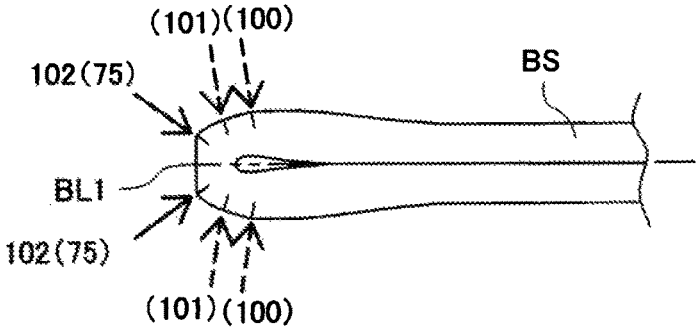

Next, in the second step, the distance between the second upper press roller 73 and the second lower press roller 74 as the press member of a bunch of sheets is defined as a distance (in this Embodiment, approximately 7 mm) slightly narrower than the loop which is pressed and formed in the first step, and the rollers shift along the fold added by the folding rollers 45 to make the folds of the second step. The folds are the second fold lines 101 shown by the solid-line arrows positioned closer to the back side than the first fold lines 100 shown in FIG. 14B, and in FIGS. 15A to 15C, appear as the second fold line 101 by thin lines in the bunch of folding sheets BS. This is also because portions pressed by the second upper press roller 73 and second lower press roller 74 undergo concentrated loads in the portion made the loop as shown in FIG. 14B, the bunch of sheets buckles and is folded, and the portions appear as the second fold line 101 by a shift of the second upper press roller 73 and second lower press roller 74 in the width direction.

The third upper press roller 75 and third lower press roller 76 as the press member of a bunch of sheets as the last step press by elastic forces of the third upper press roller pressing spring 149*a* and third lower press roller pressing spring 149*b*. In the last step, the third upper press roller 75 and third lower press roller 76 are not provided with any distance (in this Embodiment, the regulation distance is 0 mm) unlike the first step and second step.

Accordingly, in pressing in the last step, the position of the pressed thickness of the bunch of folding sheets BS is pressed by the third upper press roller 75 and third lower press roller 76, and is shifted in the fold position. The folds of the press rollers 70 of the last row are the last fold lines 102 shown by the solid-line arrows in FIG. 14C in the bunch of folding sheets BS, and in FIG. 15A, appear as the last fold line 102 by the relatively thick line in the bunch of folding sheets BS.

In addition, in the end portions in the width direction of the bunch of folding sheets BS are formed end-portion folds 103 in moving onto the sheets from the press-contact state of the folding rollers 45 and press rollers 70. In the portion pressed by the third upper press roller 75 and third lower press roller 76 in a press-contact state, the fold appears as the last fold line 102 with the fold enhanced.

As described above, the folds are formed by buckling with different distances between respective press rollers 70, by this means, in each line position of the first fold line 100 that is the thin line of the first step, the second fold line 101 that is the thin line of the second step, and the last fold line 102 that is the relatively thick line occurring corresponding to the thickness of the bunch of folding sheets BS in the last step, the folding direction faces the close direction (line in the transport direction passing through the fold) side of the bunch of folding sheets BS, and it is thereby possible to prevent alignment characteristics and collection characteristics from decreasing, as compared with the previous apparatus for pressing the end by the fold press roller where the bunch of folding sheets BS is open after discharging.

[Folded Sheets Subjected to Step-Folding]

Figure 15B:
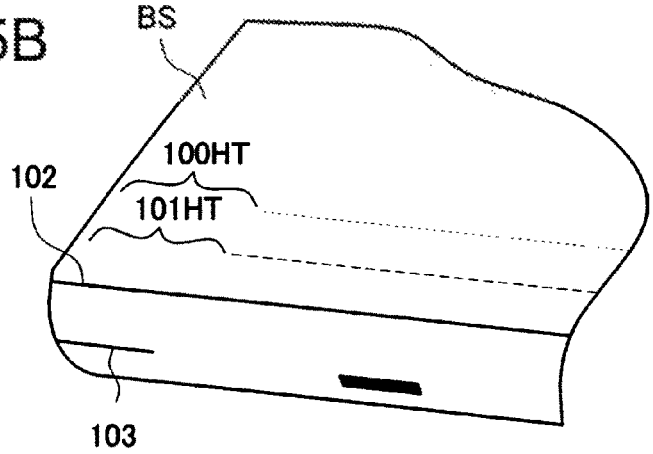
Figure 15C:
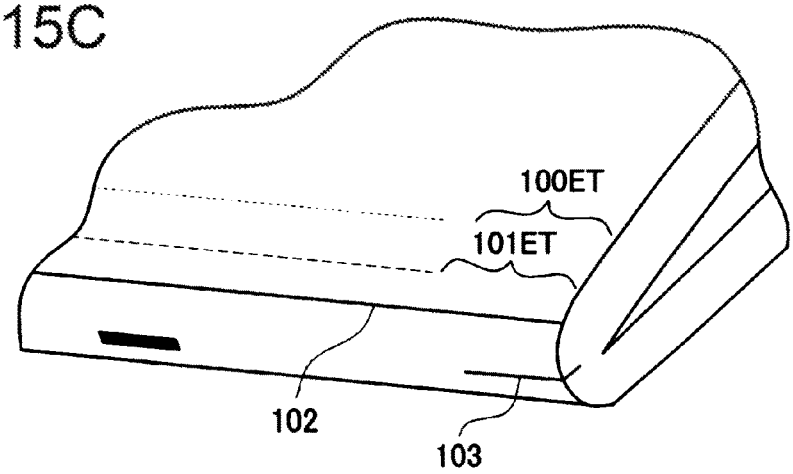

As described above, it is reduced that folded sheets are open, as compared with the conventional apparatus for pressing only the fold, and it was understood there was still room for improvement. In other words, FIGS. 15A to 15C contain views illustrating the booklet pressed by the press rollers shown in FIGS. 14A to 14C, as described previously, and in FIG. 15A, the bunch of folding sheets pressed by the support unit of FIGS. 11 to 13 was loose in folding in the end portions in the width direction of folded sheets, and was in a state in which the sheets were not folded firmly. As shown in FIG. 15B, clear fold lines did not appear in an end portion 100HT of the first fold line 100 that is the thin line of the first step on the home position (HP) side of the support unit 56, and in an end portion 101HT of the second fold line 101 that is the thin line of the second step. Further, it was found that fold lines were added little particularly to an end portion 100ET of the first fold line 100 that is the thin line of the first step on the end position (EP) side that is the return position, and an end portion 101ET of the second fold line 101 that is the thin line of the second step.

Figure 16:
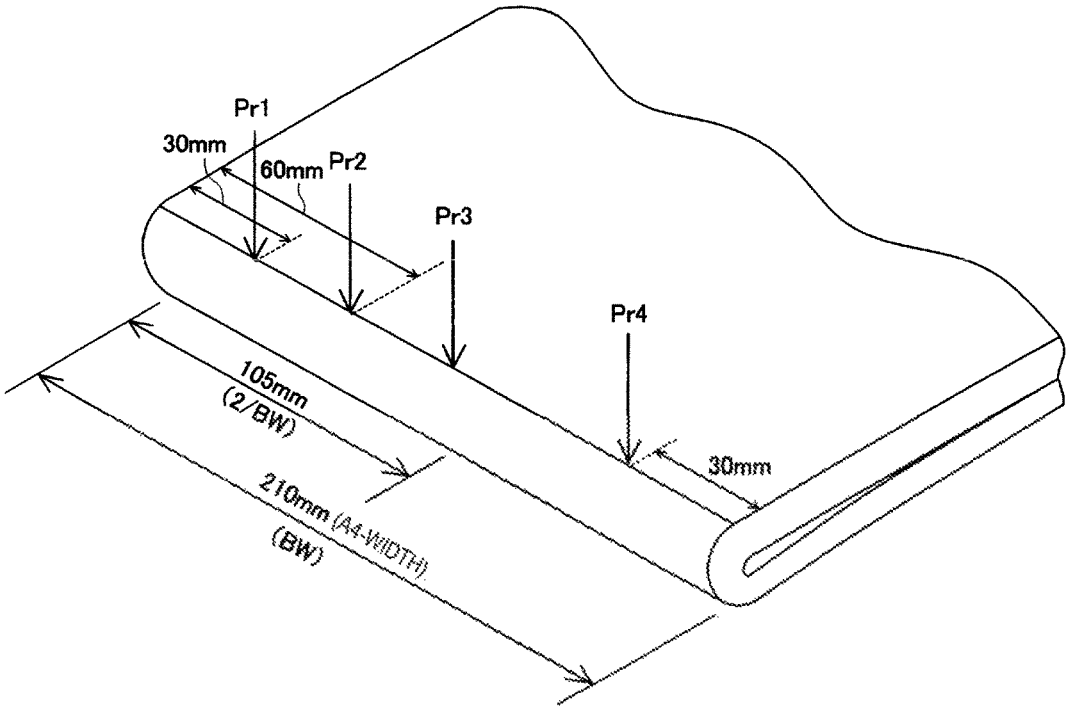
FIG. 16 is an explanatory view to examine a cause of insufficient folding in sheet end portions of FIGS. 15A to 15C.

The inventor of the present invention searched for a cause that folding was firmly not given to opposite portions in the sheet width direction of folded sheets i.e. end portions on the home position (HP) side and the end position (EP) side of the support unit 56, and clarified the fact that a reaction force that is stiffness of the folded loop of folding sheets differs. FIG. 16 shows experiments performed to confirm the fact, where used sheets were A4-sized sheets with weighing of 81.4 g/m$^2$ and a width of 240 mm, and in folded sheets folded in the position of the folding rollers 45, measurement was performed by pushing a push gage into 15 mm in a 30-mm position Pr1 from the end portion of a bunch of folding sheets on the home position side of the support unit 56, a 60-mm position Pr2 from the end portion, and a center position Pr3 in the width direction of the folded sheets. The measurement results are as shown in the following table. In addition, in FIG. 16, notation of BW represents a width of a bunch of sheets, and a half width is represented by 2/BW.

TABLE 1

| Reference numeral in FIG. 16 | Push position of push gage | Measurement Result (Reaction force N) |
|---|---|---|
| Pr1 | Near 30 mm from the HP-side end portion | About 2.7 |
| Pr2 | Near 60 mm from the HP-side end portion | About 4.3 |
| Pr3 | Near the center in opposite end portions of folded sheets | About 6.8 |

As can be seen from the above-mentioned table, it was understood that stiffness (reaction force) of the folded loop of folding sheets is the highest in the center, and is lower on the end-portion side. Further, when the folded loop portion of folding sheets was observed by actually shifting the support unit 56, it was also understood that in the fold line to the end portion Pr1 on the home position (HP) side, and the fold line between Pr4 on the end position (EP) side in the same 30-mm position from the end portion as Pr1 and the sheet bunch end, the fold line from Pr4 to the end is harder to add. This fact is considered being related to the presence or absence of sheet continuity in the shift direction when the support unit 56 is actually shifted. Accordingly, corresponding to the extent of the number of sheets, the support unit may be moved to reciprocate in a part to add the fold only on the end position side.

[Shifts of the Support Unit]

Figure 17A:
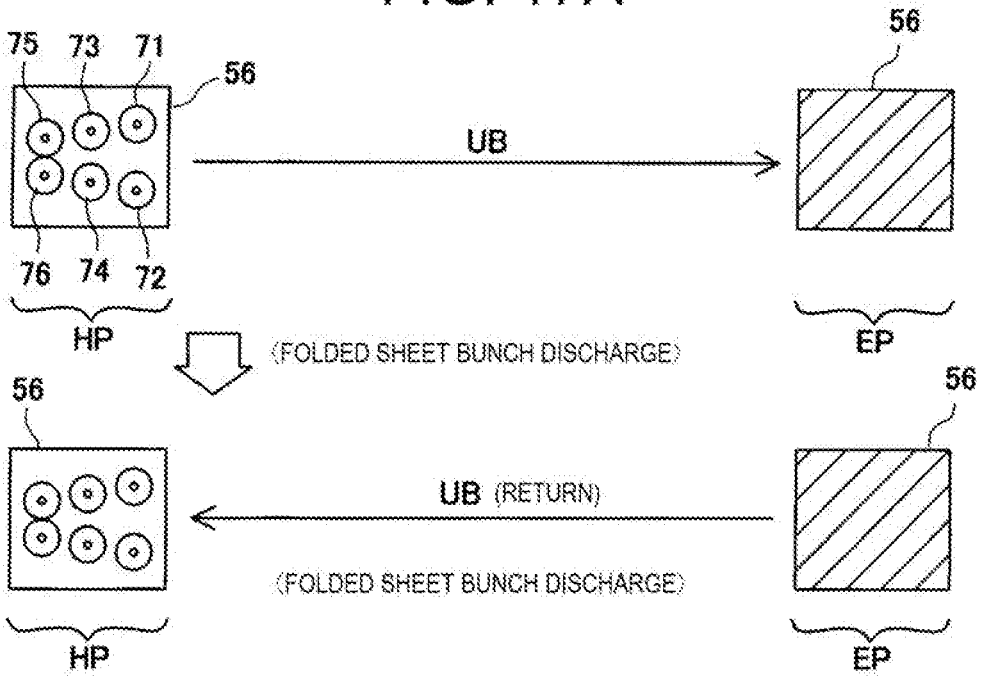
FIGS. 17A and 17B contain views to explain shift states of the support unit from FIG. 11 to FIG. 14C, where
Figure 17B:
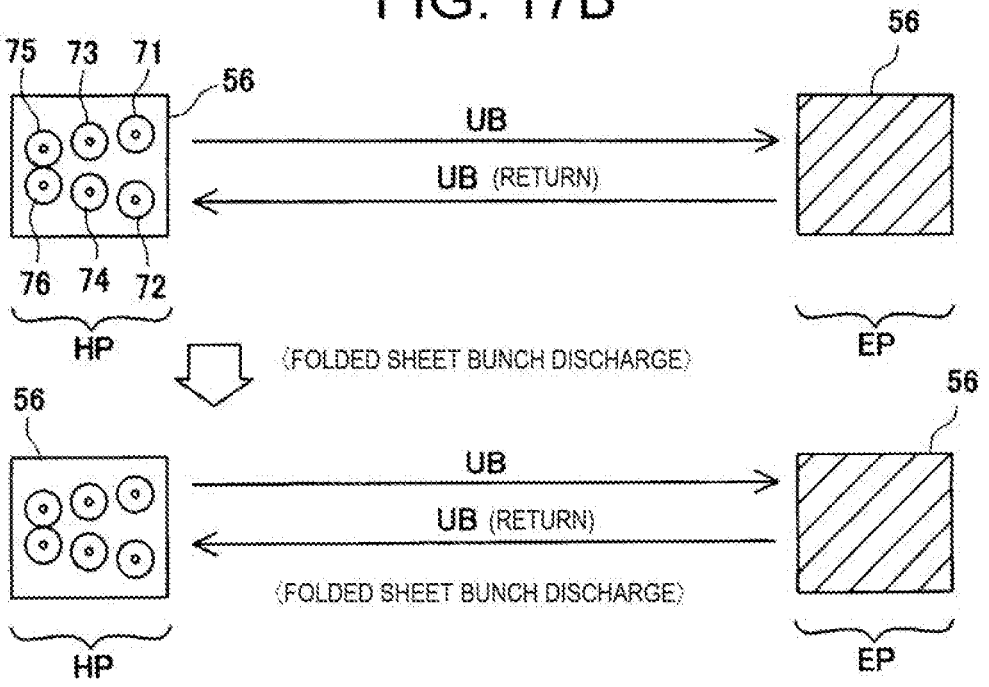

Described next are support unit shifts in the sheet width BW direction with respect to the folded loop of the support unit 56. In addition, the arrow UB represents a shift direction of the support unit 56, FIGS. 17A and 17B are to explain the shift of the support unit already explained in FIGS. 11 to 13, and FIGS. 18A to 19B show improved shifts of the support unit 56 of FIGS. 17A and 17B according to the present invention. The figures will be described below sequentially.

[Previous Shifts of the Support Unit]

FIGS. 17A and 17B are already described in FIGS. 11 to 13, and detailed descriptions on FIGS. 17A and 17B are omitted herein. In FIG. 17A, the support unit 56 shifts from the home position (HP) toward the end position (EP), sequentially presses the folded loop of folding sheets starting with the first upper press roller 71 and first lower press roller 72 sequentially up to the third upper press roller 75 and third lower press roller 76 in press contact with each other, and discharges the folded sheets. In FIG. 17B, the support unit 56 reciprocates in the direction of the sheet bunch width BW to press the folded loop. Herein, particularly, the third upper press roller 75 and third lower press roller 76 in press contact with each other press the folded loop twice, and therefore, it is possible to perform folding more as compared with press in FIG. 17A. However, the fold is hard to add, particularly, in the folded loop end portion on the end position (EP) side, and as shown in FIGS. 14A to 15C, since the fold is weak, there is room for improvement.

[Shifts of the Support Unit According to the Present Invention]

Therefore, FIGS. 18A to 19B show the fold clarified by pressing the end portion, particularly, a part of a region of the end portion on the end position (EP) side a plurality of times.

Embodiment 1

Figure 18A:
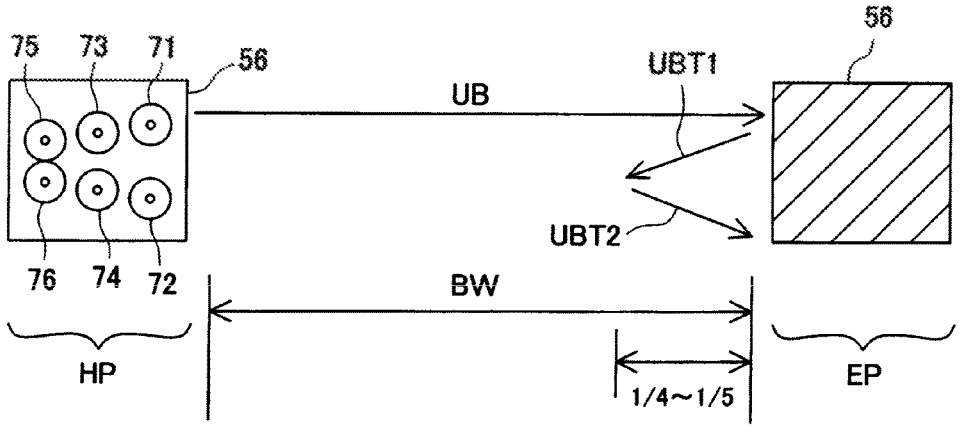
FIGS. 18A and 18B illustrate operation of the support unit according to the present invention, where
Figure 18B:
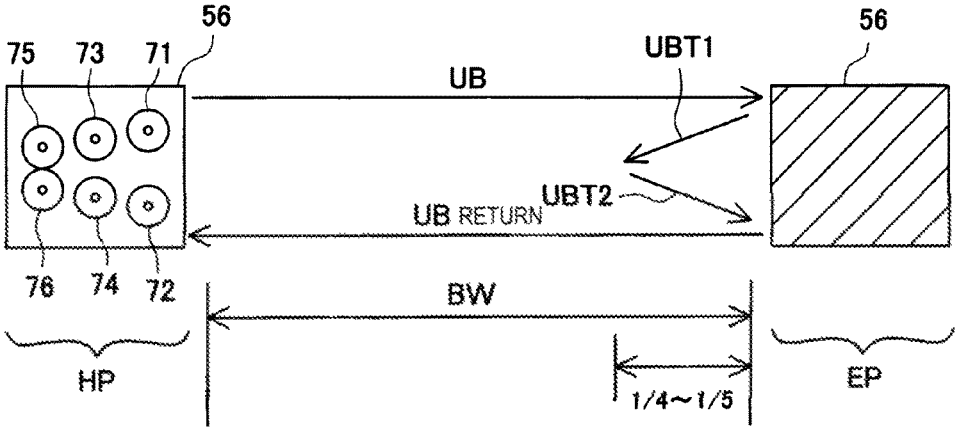

In FIGS. 18A and 18B, the support unit 56 reciprocates in a part on the end position (EP) side of FIG. 17A to press the folded sheet end portion. As shown in the figure, when the support unit 56 arrives at the folded sheet end on the end position (EP) side in the end position (EP), at this point, the unit 56 returns to the home position (HP) position, and returns. This return shift is set at about ¼ to about ⅕ of the bunch width of sheets. When the support unit 56 shifts by about ¼ to about ⅕, the unit 56 shifts again toward the end position (EP) side, moves out of the folded loop of folding sheets to shift to the end position (EP), discharges the bunch of pressed folding sheets, and waits for carry-in of next folding sheets. According to this manner, since the folded sheet end portion on the end position (EP) side is pressed by the press rollers 70 a plurality of times, as compared with the folded sheets pressed by the support unit 56 of FIGS. 17A and 17B, the end portion side on the end position (EP) side is folded reliably.

Embodiment 2

In FIG. 18B, the support unit 56 of FIG. 18A performs reciprocating shifts of support unit end portion shift/end portion shift UBT1 and UBT2 in the end portion on the end position (EP) side, and then, returns to the home position (HP). Subsequently, the first bunch of folding sheets is discharged, and the unit waits for carry-in of the next bunch of folding sheets in the home position (HP). According to this Embodiment 2, also during the process of returning from the end position (EP) to the home position (HP) of the support unit 56, the folded loop of folding sheets is pressed again, folding in the end portion on the end position (EP) side is made reliably, and the fold is easier to add than in Embodiment 1. In addition, a range of reciprocating shifts of the support unit end portion shift/end portion shift UBT1 and UBT2 is set at about ¼ to about ⅕ of the bunch width of sheets, and is the same as in Embodiment 1.

Embodiment 3

Embodiment 3 will be described next in FIG. 19A. Herein, the support unit 56 performs reciprocating motion near the opposite end portions on the home position (HP) side and the end position (EP) side in the sheet width direction. In other words, the support unit 56 shifts from the home position (HP) to the folded loop of folding sheets, in the vicinity thereof performs reciprocating shifts of support unit end portion shift/end portion shift UBT1 and UBT2, and then, shifts toward the end position (EP). When the shift is completed, the unit discharges the folded sheets, and waits for the next folding sheets. By this means, as compared with the shift shown in FIGS. 18A and 18B, the support unit 56 performs reciprocating motion near the end portion in the range of about ¼ to about ⅕ of the bunch width of sheets also on the home position (HP) side, and therefore, the opposite end portions of the folded loop are firmly folded.

Embodiment 4

Next, referring to FIG. 19B, Embodiment 4 will be described on the shift of the support unit 56. In this Embodiment, the support unit 56 performs reciprocating motion near the opposite end portions on the home position (HP) side and the end position (EP) side in the sheet width direction, and then, shifts from the end position (EP) to the home position (HP). Subsequently, the unit discharges the bunch of folding sheets, and waits for carry-in of the next bunch of folding sheets. Therefore, although it takes much time to process a single bunch of sheets, folding accuracy is more improved. Also herein, the support unit 56 performs reciprocating motion near the end portion in the range of about ¼ to about ⅕ of the bunch width of sheets. In addition, it is indisputable that the unit is capable of first reciprocating on the end position (EP) side, and subsequently returning to perform reciprocating motion on the home position (HP) side that is the initial position.

[Folded Sheets Subjected to Partial Reciprocating Motion in Opposite End Portions by the Support Unit]

Figure 19A:
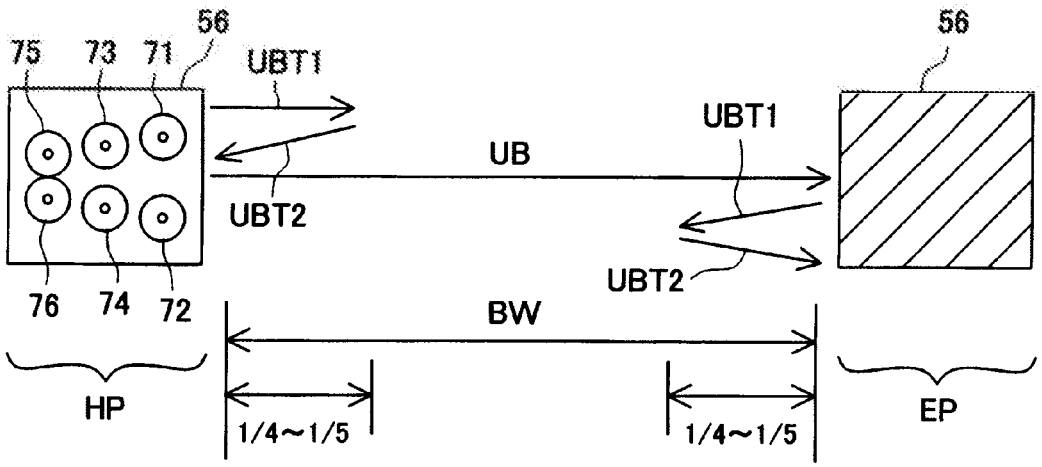
FIGS. 19A and 19B contain views illustrating other Embodiments of the support unit according to the present invention, where
Figure 19B:
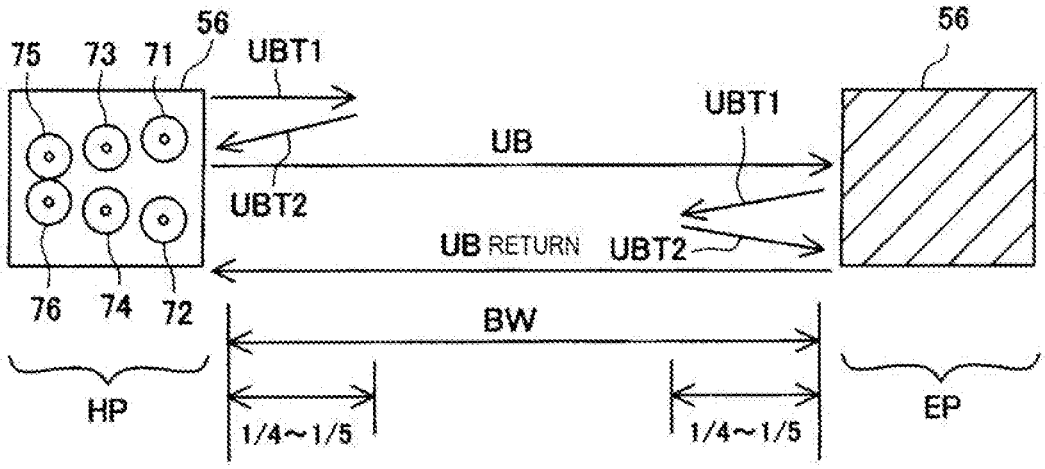
Figure 20A:
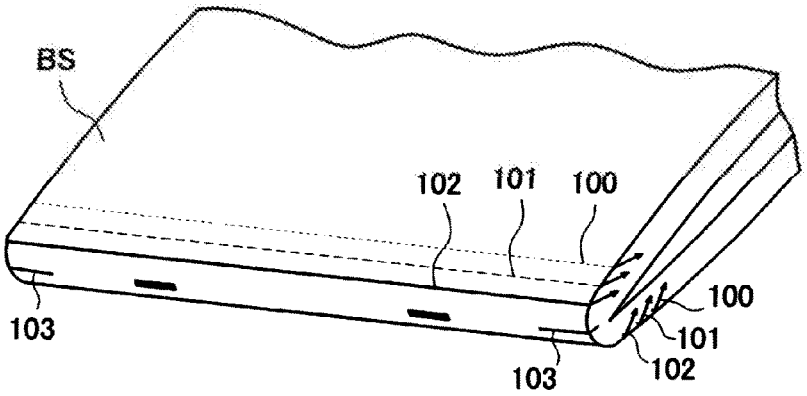
FIGS. 20A to 20C contain views illustrating the folded sheets with folds more clarified by reciprocating motion in the end portions in the width direction of the sheet loop of the support unit, where
Figure 20B:
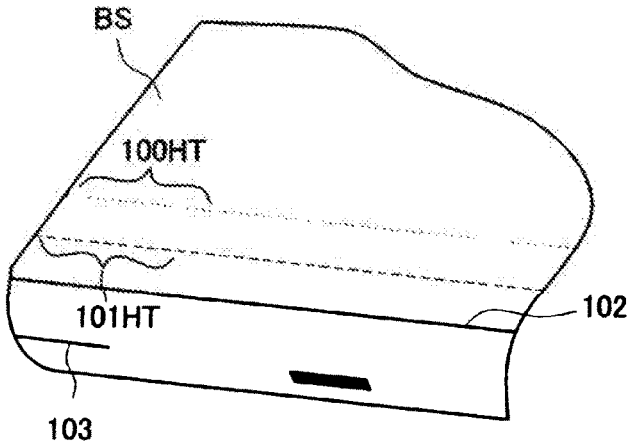
Figure 20C:
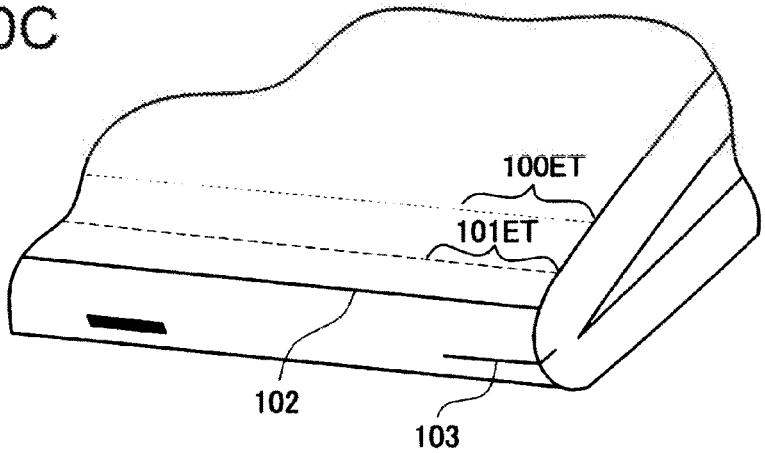

FIGS. 20A to 20C show folded sheets subsequent to reciprocating shifts of support unit end portion shift/end portion shift UBT1 and UBT2 performed on folded sheets of Embodiments 3 and 4 in FIGS. 19A and 19B. In this figure, as compared with FIGS. 15A to 15C where the support unit 56 does not perform reciprocating motion in the sheet end portion, as shown in FIG. 20A, the first fold line 100 and second fold line 101 are obviously added to the opposite end portions of the folded sheets (booklet), and folding is made up to the end portions reliably.

FIG. 20B illustrates a state in which clear fold lines appear in the end portion 100HT of the first fold line 100 that is the thin line of the first step on the home position (HP) side that is the entry side of the support unit, and in the end portion 101HT of the second fold line 101 that is the thin line of the second step. Further, as shown in FIG. 20C, the fold lines are added to also the end portion 100ET of the first fold line 100 that is the thin line of the first step on the end position (EP) side that is the return position, and the end portion 101ET of the second fold line 101 that is the thin line of the second step. By this means, by performing partial reciprocating motion of the support unit 56 on the end portions in the width direction of folded sheets, the fold is firmly added, the folded portion is open little after discharging to the second sheet discharge tray 22, collection characteristics are also improved, and further, it is possible to provide booklets with the appearance also enhanced.

In addition, in FIGS. 20A to 20C, the support unit 56 does not reciprocate in a part only on the end position (EP) side to press the folded sheet end portion corresponding to FIGS. 18A and 18B. However, when the number of folding sheets is not high, only by performing in the end position (EP) with relatively weak stiffness, it happens little that the discharged booklet is open in the fold, and therefore, corresponding to the case, reciprocating motion of the support unit 56 is sufficient only on one side.

Embodiment 5

Figure 21:
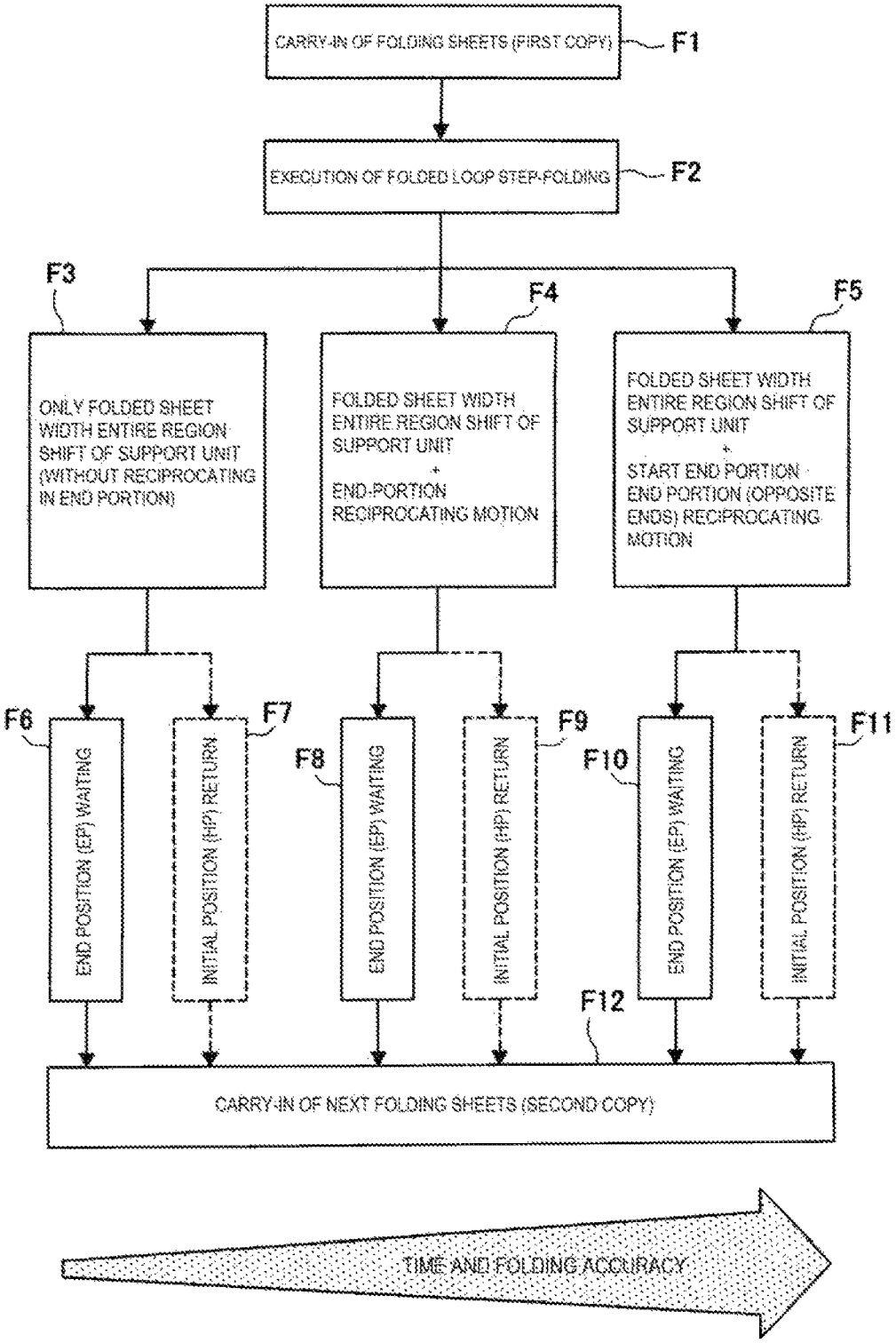
FIG. 21 is a diagram to explain shift states of the support unit shown in FIGS. 18A to 19B to finish the booklet of FIGS. 20A to 20C.

Herein, with respect to also pressing shifts of the support unit 56 to the folded loop (fold) of folded sheets from FIGS. 17A to 19B, the shifts will be organized and described with a flow diagram of FIG. 21. When an operator gives instructions for fold pressing from the control panel 18 (FIGS. 1 and 23), folding sheets folded by the folding rollers 45 are carried in the folding unit 50, and are halted in a beforehand determined position (F1). When carry-in of folded sheets is completed, the support unit 56 that supports the press rollers for pressing the fold stepwise starts a shift from the home position (HP) (F2).

Next, by the previous instructions of the operator, selected is the case (F3) of only the entire region shift of the folded sheet width of the support unit 56 without performing reciprocating motion in the end portion, the case (F4) of performing end-portion reciprocating motion only in the end position (EP), in addition to the entire region shift of the folded sheet width of the support unit 56, or the case (F5) of performing partial reciprocating motion in opposite ends of folded sheets in the home position (HP) that is the initial position and in the end position (EP), in addition to the entire region shift of the folded sheet width of the support unit 56. Further, it is also possible to select (six ways from F6 to F11) that the support unit 56 waits in the outward way from the home position (HP) to the end position (EP) and discharges the folded sheets, or that the support unit 56 shifts from the home position (HP) to the end position (EP), and further returns to the home position (HP) that is the initial position to discharge the folded sheets, and folding sheets of the second copy are carried in the folding unit (F12).

In other words, FIG. 17A described previously corresponds to FIG. 21 (F6), and FIG. 17B corresponds to FIG. 21 (F7). Further, FIG. 18A corresponds to FIG. 21 (F8), and FIG. 18B corresponds to FIG. 21 (F9). Furthermore, FIG. 19A corresponds to FIG. 21 (F10), and FIG. 19B corresponds to FIG. 21 (F11). Accordingly, as shown by the arrow in the lower stage of FIG. 21, as the time required for stepwise folding of the folded loop increases, folding accuracy is increased. As a matter of course, it is also possible to select that folded sheets subjected to the folding processing by the folding rollers 45 are bunch-discharged without undergoing folding processing with the press rollers of the support unit 56. Up to here, the example is shown where an operator inputs a shift of the support unit 56 manually from the control panel 18, and as shown below, the shift may be varied corresponding to the number of folding sheets and thickness.

Embodiment 6

Figure 22:
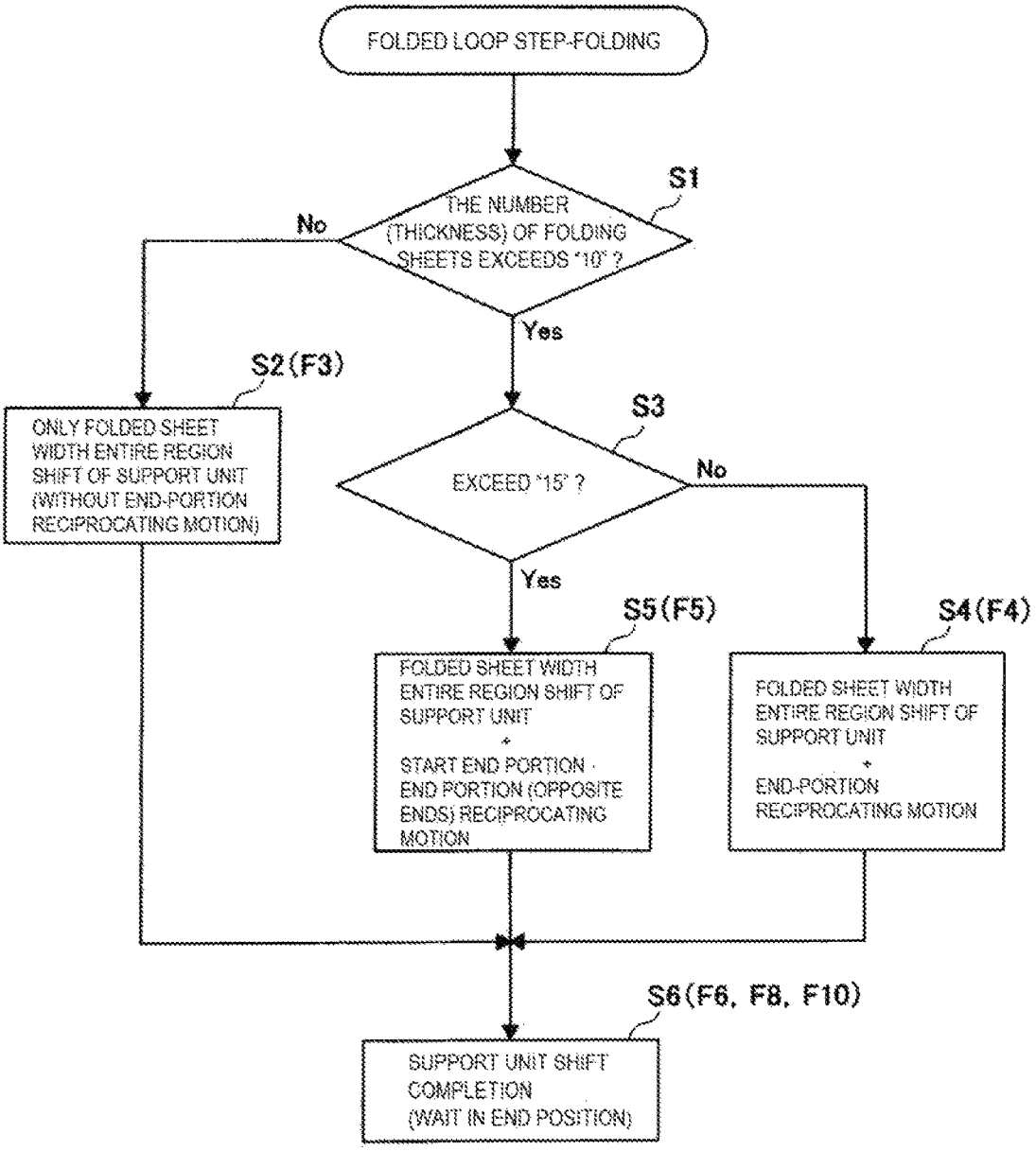
FIG. 22 is a flowchart diagram to perform a width-direction entire region shift and end portion reciprocating motion of the support unit, corresponding to the number of folding sheets.

In the foregoing, an operator inputs and selects the shift of the support unit 56, and as shown in a flowchart of FIG. 22, the shift of the support unit 56 may be performed, corresponding to the number of folding sheets or the extent of thickness. This operation will be described below. Execution of "folded loop step-folding" is instructed from the control panel 18. Then, first, the number of folding sheets is counted. This count is performed with the carry-in sensor SEN1 on the downstream side of the carry-in roller 24, or may be set by receiving count information from the image formation apparatus main body. Further, in the case of measurement of thickness, a distance between shafts of the folding rollers is measured. The following description will be given using the number of sheets as an example.

A folding sheet step-folding control section 124 (control section), described later, determines whether or not the number of folding sheets exceeds "10" (S1). In the case where the number of folding sheets does not exceed "10" in this determination (No), the flow proceeds to the left shown in FIG. 22, the support unit 56 performs only the entire region shift of a bunch of folding sheets, waits in the end position (EP) (FIG. 17A), discharges the bunch of folding sheets, and when there are next sheets, waits for carry-in of a bunch (S6).

On the other hand, when it is determined that the number exceeds "10" (Yes), it is further determined whether the number exceeds "15" (S3). In the case of not exceeding in this determination (No), the flow proceeds to the right shown in FIG. 22, the support unit 56 performs the entire region shift of the folded sheet width and reciprocating motion in the end portion in the end position (EP), waits in the end position (EP) (FIG. 18A), discharges the bunch of folding sheets, and when there are next sheets, waits for carry-in of a bunch (S6). Herein, in the case of exceeding "15" (Yes), the support unit 56 performs the entire region shift of the folded sheet width and reciprocating motion in the opposite end portions in the home position (HP) and the end position (EP), then discharges the bunch of folding sheets, and when there are next sheets, waits for carry-in of a bunch (S6).

As described above, in the case of whether to perform reciprocating motion in the end portion in the width direction corresponding to the number of sheets of a bunch of folding sheets, it is automatically determined whether to perform on only the end position (EP) or on the opposite ends. By thus setting, it is possible to shorten the time of pressing of the press rollers 70 and to improve folding accuracy. In addition, in the case where the number of folding sheets ranges from "1" to "3" or the like, it is indisputable that folding is performed by only the folding rollers 45, without shifting the support unit 56, the bunch is charged, and that it is thereby increase the processing speed.

[Explanation of Control Configurations]

Figure 23:
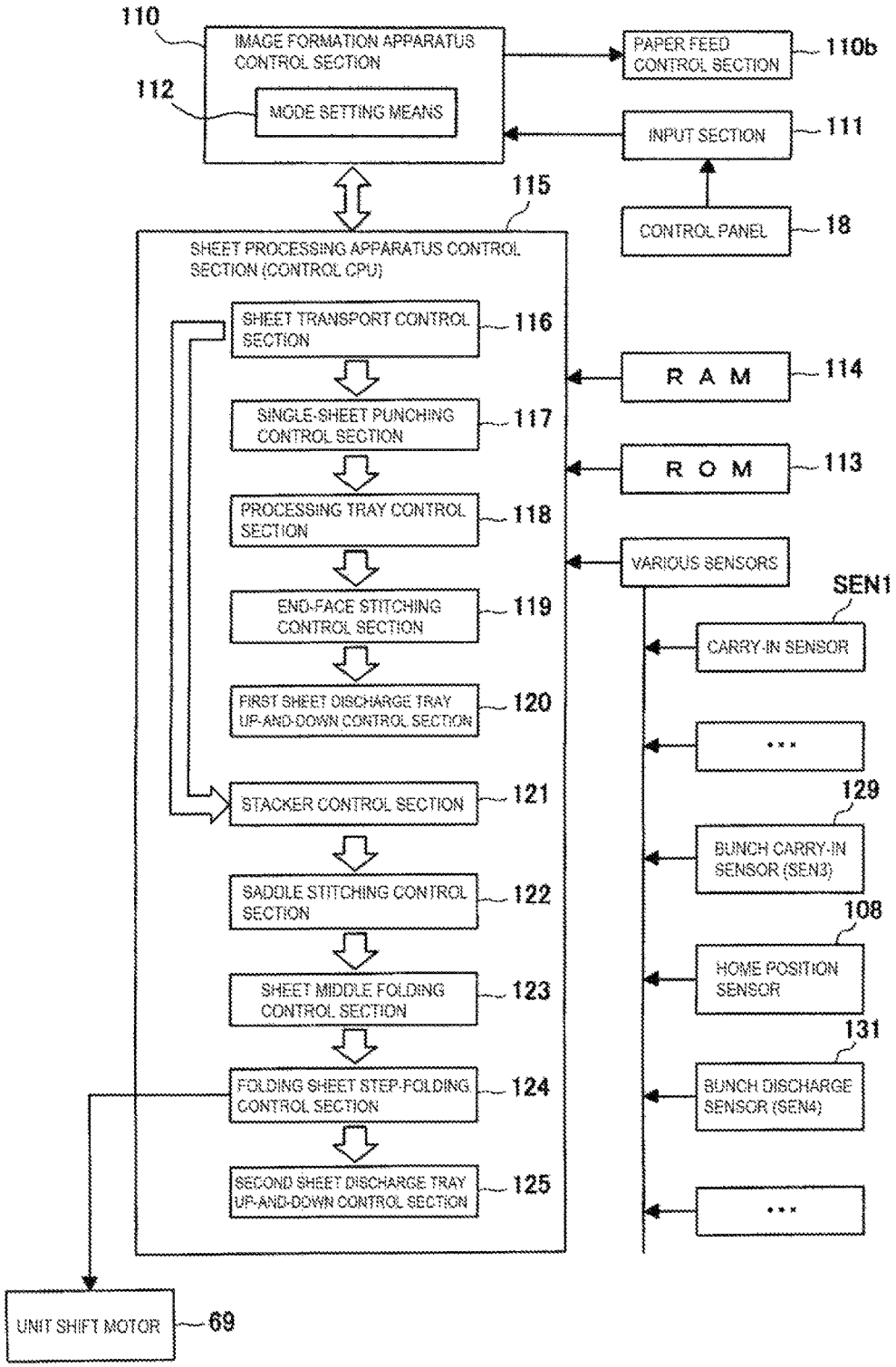
FIG. 23 is a control configuration explanatory diagram including the sheet processing apparatus according to the present invention.

Referring to a block diagram of FIG. 23, described are control configurations of the sheet processing apparatus B provided with the folding unit 50 as described in the forgoing, and the image formation apparatus A including the sheet processing apparatus B. In an image formation apparatus control section 110 provided with the image formation means, desired processing is input from an input means 111 provided in the control panel 18. This input controls a sheet processing apparatus control section 115 of the sheet processing apparatus B by a mode setting means. Further, the image formation apparatus control section 110 controls a paper feed control section 110*b* of the paper feed section 1, and outputs information on the number of folding sheets or folding sheet thickness to the sheet processing apparatus control section 115.

Processing modes of the sheet processing apparatus B of this Embodiment are provided with the following modes.

In other words, (1) "print-out mode" to store an image-formed sheet in the first sheet discharge tray 21; (2) "staple stitching mode" to collate sheets from the main-body discharge outlet 3 in the shape of a bunch, bind with the one-end face stitching staple apparatus 33, and then, store in the first sheet discharge tray 21; (3) "bunch saddle stitching bunch folding mode" to collate sheets from the main-body discharge outlet 3 in the shape of a bunch in the stacker section 35 that is the second processing tray, bind the middle of a bunch of sheets with the saddle stitching stapler 40, then fold in the shape of a booklet, and store in the second sheet discharge tray 22; and (4) "step-folding mode" to shift the support unit 56 to the loop of the fold of a bunch of sheets folded in the shape of a booklet subsequent to saddle stitching, perform step-folding by pressing the folded loop stepwise with the press rollers, and store in the second sheet discharge tray 22. It is configured to enable these modes to be designated. Further, in the "step-folding mode", corresponding to the number of folding sheets, partial reciprocating motion is performed on the end position (EP) side, or on the folded loop opposite ends of folded sheets on the home position (HP) side and the end position (EP) side to improve folding accuracy more. In addition, as described in FIG. 21, folding accuracy may be selected by mutual input.

The sheet processing apparatus B is provided with the sheet processing apparatus control section 115 enabled to operate by the above-mentioned designated mode, ROM 113 for storing operation programs, and RAM 114 for storing control data. Then, the sheet processing apparatus control section 115 is provided with a sheet transport control section 116 for controlling sheet transport inside the apparatus, a single-sheet punching control section 117 for performing pressing processing on a sheet in the single-sheet punching unit 28 on a sheet-by-sheet basis, a processing tray control section 118 for performing collection control of sheets in the processing tray 29, an end-face stitching control section 119 for binding on the end face side of sheets collected as a bunch of sheets in the processing tray 29, and after binding, discharging, and a first sheet discharge tray up-and-down control section 120 for controlling ascent/descent and the like of the first sheet discharge tray 21 corresponding to a collection amount so as to collect bunches of sheets subjected to binding processing in the processing tray 29.

Further, in the case of performing saddle stitching for binding near ½ in the sheet transport direction of a bunch of sheets, or middle folding, control is performed by a stacker section control section 121 for collecting a bunch of sheets in the stacker section 35 of sheets. This stacker section control section 121 aligns by the stopper 38 for regulating the front end of the sheet carried in the stacker section 35 on a sheet-by-sheet basis and alignment member 39 to create a bunch of sheets. Further, the section 115 is provided with a saddle stitching control section 122 for controlling the saddle stitching stapler so as to drive a staple and the like in the middle of a bunch of sheets, and a sheet middle folding control section 123 for controlling so as to push the bunch of sheets subjected to saddle stitching to the folding rollers 45 with the folding blade 46 to perform middle folding. The sheet middle folding control section 123 controls a folding motor that drives the folding rollers 45 with output signals from the bunch carry-in detection sensor (SEN3) 129, and an encoder sensor connected thereto, not particularly shown.

The section 115 is provided with the folding sheet step-folding control section 124 (control section) connected to the unit drive motor 69, which shifts the support unit 56 for supporting a plurality of rows of press rollers 70, to control the motor 69 for a bunch of folding sheets BS, according to the "step-folding mode" described above. The folding sheet step-folding control section 124 (control section) is also connected to the home position sensor 108 that checks whether the folding unit is in the home position (HP). Further, the section is also coupled to the carry-in sensor S1 positioned on the downstream side of the carry-in roller 24 to detect that a sheet is carried in the apparatus, and the bunch carry-in sensor (SEN3) 129 that detects carry-in of a bunch of folding sheets BS on the downstream side of the folding roller 45 which are particularly related to the invention.

Then, the bunch of folding sheets BS subjected to step-folding is controlled and discharged to the second sheet discharge tray to collect, by a second sheet discharge tray up-and-down control section 125 connected to a bunch discharge roller drive motor for driving the bunch discharge roller 49. The second sheet discharge tray up-and-down control section 125 is connected to the bunch discharge sensor (SEN4) 131 to check operation of discharging the bunch of folding sheets BS.

Step-folding control including the partial reciprocating shift in the end portion of folded sheets particularly related to the present invention is described in the description of each mechanism and in each operation state explanatory view of FIGS. 18A to 22, the description herein is thereby omitted, and the shift of the support unit 56 inside the folding unit 50 is controlled to execute step-folding according to the content thereof.

As described above, according to the Embodiments to carry out the invention, the effects as described below are exhibited.

1. A sheet processing apparatus is provided with pairs of press members (press rollers 70) that press a folded loop BL of folding sheets BS, and the support unit 56 that shifts in the width direction of the folding sheets, while supporting a plurality of rows with a distance between the press members being narrowed stepwise from downstream to upstream in a shift direction of the support unit, where the support unit 56 performs a sheet width entire region shift and reciprocating motion in a sheet end partial region of the folded loop, and presses the folded loop with the press members.

According to the apparatus, folding in the center portion in the width direction of sheets is made, folding in the end portion is made more reliably since the end portion in the width direction is pressed repeatedly, the folded sheets are harder to open in collection, the appearance is also enhanced, and collection characteristics are improved in stacking bunches of folded sheets.

2. The sheet processing apparatus as described in abovementioned 1, where among the plurality of rows of the press members (press rollers 70), press members (third upper press roller 75, third lower press roller 76) of the last row in the shift direction are brought into press contact with each other, and press rollers (second upper press roller 73, second lower press roller 74) before the last row are regulated in position so that a distance (L2) is not narrower than a predetermined distance.

According to the apparatus, the press rollers of the last row press the fold of folded sheets reliably, and therefore, with folding inward by each press roller, folding is made more firmly.

3. A sheet processing apparatus is provided with pairs of press rollers 70 that press a folded loop BL of folding sheets BS, a support unit that shifts from an initial position to an end position in the width direction of the folding sheets, while supporting a plurality of rows with a distance between a pair of press rollers being narrowed stepwise from downstream to upstream in a shift direction of the support unit, where the support unit 56 regulates positions so that press roller members (third upper press roller 75, third lower press roller 76) of the last row in the shift direction are brought into press contact with each other, and that press rollers (second upper press roller 73, second lower press roller 74) before the last row maintain a predetermined distance among the plurality of rows of pairs of press rollers 70, performs a shift in the sheet width entire region and reciprocating motion in a partial region of the sheet end of the folded loop, and presses the folded loop with the press rollers 70.

According to the apparatus, folding in the center portion in the width direction of sheets is made, folding in the end portion is made more reliably since the end portion in the width direction is pressed repeatedly, the folded sheets are harder to open in collection, the appearance is also enhanced, and collection characteristics are improved in stacking bunches of folded sheets.

4. The sheet processing apparatus as described in abovementioned 3, where the support unit 56 shifts from the initial position to the end position to press the folded loop with the press rollers 70, and performs reciprocating motion near the end position (EP side) to press the folded loop end portion a plurality of times with the press rollers 70 (see FIG. 18A).

According to the apparatus, since the end position (EP) side where stiffness of folded sheets is weak is particularly pressed a plurality of times, the fold of this weak portion is also added securely.

5. The sheet processing apparatus as described in abovementioned 3, where the support unit 56 shifts from the initial position (home position (HP)) to the end position (EP) to press the folded loop BL with the press rollers 70, performs reciprocating motion near the end position to press the folded loop end portion a plurality of times, and subsequently, returns to the initial position, while pressing the folded loop with the press rollers (see FIG. 18B).

According to the apparatus, since the end position (EP) side where stiffness of folded sheets is weak is particularly pressed a plurality of times, the fold of this weak portion is also added securely, it is possible to press the fold of folded sheets also during a process of returning to the initial position, and therefore, folding accuracy is further improved.

6. The sheet processing apparatus as described in abovementioned 3, where in shifting from the initial position (home position (HP)) to the end position (EP) to press the folded loop with the press rollers 70, the support unit 56 first performs reciprocating motion near the initial position to press an initial position side end portion of the folded loop a plurality of times, then shifts to the end position, and subsequently, performs reciprocating motion near the end position to press the folded loop end portion a plurality of times (see FIG. 19A).

According to the apparatus, since the press rollers press the opposite ends with relatively weak stiffness near the initial position side and near the end position side of the folded sheet loop BL a plurality of times, the fold is added more reliably, the folded sheets are harder to open, the appearance is also enhanced, and collection characteristics are improved in stacking bunches of folded sheets.

7. The sheet processing apparatus as described in abovementioned 3, where in shifting from the initial position (home position (HP)) to the end position (EP) to press the folded loop with the press rollers 70, the support unit 56 first performs reciprocating motion near the initial position to press an initial position side end portion of the folded loop a plurality of times, then shifts to the end position, subsequently performs reciprocating motion near the end position to press the folded loop end portion a plurality of times, and returns to the initial position again (see FIG. 19B).

According to the apparatus, since the press rollers press the opposite ends with relatively weak stiffness near the initial position side and near the end position side of the folded loop BL of folding sheets BS a plurality of times, and further press also during a process of returning to the initial position, the fold is added reliably to improve folding accuracy, the folded sheets are harder to open, the appearance is also enhanced, and collection characteristics are further improved in stacking bunches of folded sheets.

8. A sheet processing apparatus provided with the support unit 56 that supports a plurality of press roller units 81 for pressing the folded loop BL of folding sheets BS and that shifts from an initial position to an end position along the folded loop, where each of the press roller units 81 includes a press roller 70 capable of rotating to press the folded loop, a frame (press roller frame 85) that holds the press roller bracket 140 for holding the press roller 70 to be able to shift, and an elastic spring (press roller pressing spring 146) disposed between the frame and the roller bracket to bias the press roller in a sheet pressing direction to be configured as the unit, and the support unit 56 is configured as the unit for arranging the press roller units 81 opposite one another as pairs, and supporting a plurality of rows so that a distance between paired press roller units is narrower stepwise from downstream to upstream in the shift direction of the support unit 56, and further, shifts from the initial position to the end position to press the folded loop by performing a shift in the sheet width entire region of the folded loop and reciprocating motion in a sheet end portion at least near the end position.

According to the foregoing, the press roller units are incorporated into the support unit 56, incorporation is thereby easy, folding in the center portion in the width direction of sheets and folding in the end portion is made more reliably by pressing the end portion in the width direction repeatedly, the folded sheets are harder to open, the appearance is also enhanced, and collection characteristics are improved in stacking bunches of folded sheets.

9. The sheet processing apparatus as described in abovementioned 8, where the support unit 56 performs reciprocating motion also in the sheet end portion near the initial position to press the opposite ends of the folded loop.

According to the apparatus, the opposite end portions of the folded loop BL are folded more reliably.

10. A sheet processing apparatus is provided with pairs of press members (press rollers 70) that press the folded loop BL of folding sheets BS, the support unit 56 that shifts in the width direction of the folding sheets, while supporting a plurality of rows with a distance between the press members being narrowed stepwise from downstream to upstream in a shift direction of the support unit; and a control section (folding sheet step-folding control section 124) that controls a shift in the width direction of the support unit, where the control section selectively performs an entire region pressing shift for the support unit to press a sheet width entire region of the folded loop with the press members, and an end portion region pressing shift for pressing a width end portion of the folded loop by performing reciprocating motion in a sheet end portion region, in addition to the entire region pressing shift.

According to the apparatus, folding in the center portion in the width direction of sheets is made, folding in the end portion is made more reliably since the end portion in the width direction is repeatedly pressed selectively when necessary e.g. the number of sheets is high, the folded sheets are harder to open, the appearance is also enhanced, and collection characteristics are improved in stacking bunches of folded sheets.

11. The sheet processing apparatus as described in abovementioned 10, where when a thickness of folding sheets exceeds a predetermined thickness, the control section executes the end portion region pressing shift of the support unit.

According to the apparatus, since end portion pressing is executed when the thickness of folding sheets exceeds a predetermined thickness, time is not required for processing of folding sheets without the need.

12. The sheet processing apparatus as described in abovementioned 10, where when the number of folding sheets exceeds the predetermined number of sheets, the control section executes the end portion region pressing shift of the support unit.

According to the apparatus, since end portion pressing is executed when the number of folding sheets exceeds the predetermined number of sheets, time is not required for processing of folding sheets without the need.

13. A sheet processing apparatus is provided with pairs of press rollers 70 that press the folded loop BL of folding sheets BS, the support unit 56 that shifts from an initial position (home position (HP)) to an end position (EP) in the width direction of the folding sheets, while supporting a plurality of rows with a distance between a pair of press rollers 70 being narrowed stepwise from downstream to upstream in a shift direction of the support unit; and a control section (folding sheet step-folding control section 124) that controls a shift in the width direction of the support unit, where the support unit 56 regulates positions so that press rollers (third upper press roller 75, third lower press roller 76) of the last row in the shift direction are brought into press contact with each other, and that press rollers (second upper press roller 73, second lower press roller 74) before the last row maintain a predetermined distance (L2) among the plurality of rows of pairs of press rollers 70, and the control section selectively performs an entire region pressing shift for the support unit to press a sheet width entire region of the folded loop with the press rollers 70, and an end portion region pressing shift for pressing a width end portion of the folded loop with the press rollers 70 by performing reciprocating motion in a sheet end portion region, in addition to the entire region pressing shift.

According to the apparatus, folding in the center portion in the width direction of sheets is made, folding in the end portion is made more reliably since the end portion in the width direction is repeatedly pressed selectively when necessary e.g. the number of sheets is high, the folded sheets are harder to open in collection, the appearance is also enhanced, and collection characteristics are improved in stacking bunches of folded sheets.

14. The sheet processing apparatus as described in abovementioned 13, where when a thickness of folding sheets exceeds a predetermined thickness or the number of folding sheets exceeds the predetermined number of sheets, the control section (folding sheet step-folding control section 124) executes the end portion region pressing shift of the support unit.

According to the apparatus, folding in the center portion in the width direction of sheets is made, the end portion in the width direction is repeatedly pressed selectively when necessary e.g. the thickness of sheets is thick, the number of sheets is high, and therefore, processing time is not increased in the case of thin sheets or the case where the number of sheets is low.

15. The sheet processing apparatus as described in abovementioned 13, where when a thickness of folding sheets exceeds a predetermined thickness or the number of folding sheets exceeds the predetermined number of sheets, the control section (folding sheet step-folding control section 124) further selects executing the end portion region pressing shift of the support unit in the end of the folded loop or executing the end portion region pressing shift in the opposite end portions, corresponding to an exceeding state.

According to the apparatus, the end position or opposite ends are selected to press the end portion of the folded loop corresponding to the number of folding sheets or the thickness, and therefore, the balance is achieved between folding accuracy and processing time.

16. The sheet processing apparatus as described in above-mentioned 13, where when a thickness of folding sheets exceeds a predetermined thickness or the number of folding sheets exceeds the predetermined number of sheets, the control section (folding sheet step-folding control section 124) executes the end portion region pressing shift of the support unit near the end position.

According to the apparatus, when the number or thickness is within some range, pressing is performed on only the end position (EP) side where folding is relatively not sufficient, and therefore, it is possible to perform the processing corresponding to folding sheets.

17. The sheet processing apparatus as described in above-mentioned 16, where the control section (folding sheet step-folding control section 124) executes the end portion region pressing shift of the support unit near the end position, and then, further executes the end portion region pressing shift also near the initial position.

According to the apparatus, since pressing is performed on the end position (EP) side and the home position (HP) side on the initial position side, it is possible to fold the folding sheets more firmly.

18. The sheet processing apparatus as described in above-mentioned 13, where the control section (folding sheet step-folding control section 124) executes the end portion region pressing shift near the initial position by the support unit, then executes the entire region pressing shift, and subsequently to the entire region pressing shift, executes the end portion region pressing shift near the end.

According to the apparatus, end portion pressing is selected, while pressing the opposite end portions when necessary, folding in the end portion is made more reliably, the folded sheets are harder to open, the appearance is also enhanced, and collection characteristics are improved in stacking bunches of folded sheets.

19. An image formation apparatus is provided with the image formation section 2 that forms an image on a sheet, and the sheet processing apparatus B that performs predetermined sheet processing on the sheet from the image formation section, where the sheet processing apparatus B is provided with the sheet processing apparatus as described in above-mentioned 1.

According to the apparatus, it is possible to provide the image formation apparatus exhibiting the effects as described in above-mentioned 1.

20. A sheet fold pressing method of pressing a fold of a folded loop by shifting a support unit, provided with pairs of press rollers that press the folded loop of folding sheets, and the support unit that shifts from an initial position to an end position in the width direction of the folding sheets, while supporting as rows with a distance between the press rollers being narrowed stepwise from downstream to upstream in a shift direction of the support unit, is comprised of a sheet width entire region pressing step of shifting the support unit in the sheet width entire region of the folded loop to press the sheets, and a folded loop end portion pressing step of performing reciprocating motion in an end portion region in the sheet width.

According to the method, folding in the center portion in the width direction of sheets is made, folding in the end portion is made more reliably since the end portion in the width direction is pressed repeatedly, the folded sheets are harder to open in collection, the appearance is also enhanced, and collection characteristics are improved in stacking bunches of folded sheets.

In addition, in the description of the effects in the Embodiments in the foregoing, for each portion of the Embodiments, each component in the scope of the claims is shown in the parenthesis, or assigned the reference numeral to clarify the relationship between both the portion and the component.

Further, the present invention is not limited to the above-mentioned Embodiments, various modifications thereof are capable of being made in the scope without departing from the invention, and all technical matters included in the technical ideas described in the scope of the claims are subjects of the invention. The Embodiments described previously illustrate preferred examples, a person skilled in the art is capable of achieving various types of alternative examples, corrected examples, modified examples or improved examples from the content disclosed in the present Description, and the examples are included in the technical scope described in the scope of the claims attached herewith.

In addition, this application claims priority from Japanese Patent Application No. 2016-015716 filed on Jan. 29, 2016 in Japan, and Japanese Patent Application No. 2016-015717 filed on Jan. 29, 2016, incorporated herein by reference.

The invention claimed is:

1. A sheet processing apparatus comprising:

pairs of press members adapted to press a folded loop of folding sheets; and a support unit adapted to shift in a width direction of the folding sheets, while supporting the pairs of press members in a plurality of rows with a distance between each of the pairs of the press members in each row being narrowed stepwise from downstream to upstream in a shift direction of the support unit from an initial position where the plurality of rows is apart from one end portion of the folding sheets in a width direction of the folding sheets to an end position where the plurality of rows is apart from the other end portion of the folding sheets in the width direction of the folding sheets, wherein the support unit performs a sheet width entire region shift from the initial position to the end position and a reciprocating motion between a sheet end partial region of the folded loop where the plurality of rows is on the folded loop and at least one of the end position and the initial position, and presses the folded loop with the press members.

2. The sheet processing apparatus according to claim 1, wherein among the plurality of rows of the press members, the press members in the pairs of press members located in a last row in the shift direction are brought into press contact with each other, and the press members in the pairs of press members before the last row are regulated in position so that a distance is not narrower than a predetermined distance.

3. An image formation apparatus comprising:

an image formation section adapted to form an image on a sheet; and a sheet processing apparatus adapted to perform predetermined sheet processing on the sheet from the image formation section, wherein the sheet processing apparatus is provided with the sheet processing apparatus according to claim 1.

4. A sheet processing apparatus comprising:

pairs of press rollers adapted to press a folded loop of folding sheets;

a support unit adapted to support the pairs of press rollers in a plurality of rows with a distance between each of the pair of press rollers in each row being narrowed stepwise from downstream to upstream in a shift direction of the support unit from an initial position where the plurality of rows is apart from one end portion of the folding sheets in a width direction of the folding sheets to an end position where the plurality of rows is apart from the other end portion of the folding sheets in the width direction of the folding sheets, to shift from the initial position to the end position, wherein the support unit regulates positions so that the press rollers in the pairs of pressing members located in a last row in the shift direction are brought into press contact with each other, and that the press rollers in the pairs of pressing members before the last row maintain a predetermined distance among the plurality of rows of the pairs of pressing rollers, performs a sheet width entire region shift from the initial position to the end position and a reciprocating motion between a sheet end partial region of the folded loop where the plurality of rows is on the folded loop and at least one of the initial position and the end position, and presses the folded loop with the press rollers.

5. The sheet processing apparatus according to claim 4, wherein the support unit shifts from the initial position to the end position to press the folded loop with the press rollers, and performs the reciprocating motion between the sheet end partial region of the folded loop near the end position and the end position to press the sheet end partial region of the folded loop near the end position a plurality of times with the press rollers.

6. The sheet processing apparatus according to claim 4, wherein the support unit shifts from the initial position to the end position to press the folded loop with the press rollers, performs the reciprocating motion between the sheet end partial region of the folded loop near the end position and the end position to press the sheet end partial region of the folded loop near the end position a plurality of times, and subsequently, returns to the initial position.

7. The sheet processing apparatus according to claim 4, wherein in shifting from the initial position to the end position to press the folded loop with the press rollers, the support unit first performs the reciprocating motion between the sheet end partial region of the folded loop near the initial position and the initial position to press the sheet end partial region of the folded loop near the initial position a plurality of times, and subsequently, performs the reciprocating motion between the sheet end partial region of the folded loop near the end position and the end position to press the sheet end partial region of the folded loop near the end position a plurality of times.

8. The sheet processing apparatus according to claim 4, wherein in shifting from the initial position to the end position to press the folded loop with the press rollers, the support unit first performs the reciprocating motion between the sheet end partial region of the folded loop near the initial position and the initial position to press the sheet end partial region of the folded loop near the initial position a plurality of times, and subsequently performs the reciprocating motion between the sheet end partial region of the folded loop near the end position and the end position to press the sheet end partial region of the folded loop near the end position a plurality of times, and returns to the initial position again.

9. A sheet processing apparatus provided with a support unit adapted to support a plurality of press roller units for pressing a folded loop of folding sheets and to shift from an initial position where a plurality of rows of the press roller units are apart from one end portion of the folding sheets in a width direction of the folding sheets to an end position where the plurality of rows are apart from the other end portion of the folding sheets along the folded loop, wherein each of the press roller units includes a press roller capable of rotating to press the folded loop, a frame adapted to hold a roller bracket for holding the press roller to be able to shift, and an elastic spring disposed between the frame and the roller bracket to bias the press roller in a sheet pressing direction to be configured as the unit, and the support unit is configured as the unit for arranging the press roller units opposite one another as pairs, and supporting the plurality of rows so that a distance between paired press roller units is narrower stepwise from downstream to upstream in a shift direction of the support unit from the initial position to the end position, and further, shifts from the initial position to the end position to press the folded loop by performing a shift in a sheet width entire region of the folded loop and a reciprocating motion between a sheet end partial region of the folded loop where the plurality of rows is on the folded loop and at least one of the initial position and the end position.

10. The sheet processing apparatus according to claim 9, wherein the support unit performs the reciprocating motion between the sheet end partial region of the folded loop near the initial position and the initial position to press the sheet end partial region of the folded loop near the initial position, and the reciprocating motion between the sheet end partial region of the folded loop near the end position and the end position to press the sheet end partial region of the folded loop near the end position.

11. A sheet processing apparatus comprising:

pairs of press members adapted to press a folded loop of folding sheets;

a support unit adapted to shift in a width direction of the folding sheets, while supporting the pairs of press members in a plurality of rows with a distance between each of the press members in each row being narrowed stepwise from downstream to upstream in a shift direction of the support unit from an initial position where the plurality of rows is apart from one end portion of the folding sheets in a width direction of the folding sheets to an end position where the plurality of rows is apart from the other end portion of the folding sheets in a width direction of the folding sheets; and a control section adapted to control a shift in the width direction of the support unit, wherein the control section selectively performs an entire region pressing shift for the support unit to press a sheet width entire region of the folded loop from the initial position to the end position with the press members, and an end portion region pressing shift for pressing a sheet width end portion region of the folded loop by performing a reciprocating motion between the sheet width end portion region of the folded loop where the plurality of rows is on the folded sheets and at least one of the initial position and the end position, in addition to the entire region pressing shift.

12. The sheet processing apparatus according to claim 11, wherein when a thickness of the folding sheets exceeds a predetermined thickness, the control section executes the end portion region pressing shift of the support unit.

13. The sheet processing apparatus according to claim 11, wherein when a number of the folding sheets exceeds a predetermined number of sheets, the control section executes the end portion region pressing shift of the support unit.

14. A sheet processing apparatus comprising:

pairs of press rollers adapted to press a folded loop of folding sheets;

a support unit adapted to support a plurality of rows of the pairs of press rollers with a distance between each of the pair of press rollers in each row being narrowed stepwise from downstream to upstream in a shift direction of the support unit, and to shift from an initial position where the plurality of rows is apart from one end portion of the folding sheets in a width direction of the folding sheets to an end position where the plurality of rows is apart from the other end portion of the folding sheets in the width direction of the folding sheets; and a control section adapted to control a shift in a width direction of the support unit, wherein the support unit regulates positions so that the press rollers in the pairs of pressing members located in a last row in the shift direction are brought into press contact with each other, and that the press rollers in the pairs of pressing members before the last row maintain a predetermined distance among the plurality of rows of the pairs of press rollers, and the control section selectively performs an entire region pressing shift for the support unit to press a sheet width entire region of the folded loop from the initial position to the end position with the press rollers, and an end portion region pressing shift for pressing a width end portion of the folded loop with the press rollers by performing a reciprocating motion between the end portion region of the folded loop where the plurality of rows is on the folded loop and at least one of the initial position and the end position, in addition to the entire region pressing shift.

15. The sheet processing apparatus according to claim 14, wherein when a thickness of the folding sheets exceeds a predetermined thickness or a number of the folding sheets exceeds a predetermined number of sheets, the control section executes the end portion region pressing shift of the support unit.

16. The sheet processing apparatus according to claim 14, wherein when a thickness of the folding sheets exceeds a predetermined thickness or a number of the folding sheets exceeds a predetermined number of sheets, the control section executes the end portion region pressing shift of the support unit between the width end portion of the folded loop near the end position and the end position.

17. The sheet processing apparatus according to claim 16, wherein the control section executes the end portion region pressing shift of the support unit between the width end portion of the folded loop near the end position and the end position, and then, further executes the end portion region pressing shift also between the width end portion of the folded loop near the initial position and the initial position.

18. The sheet processing apparatus according to claim 14, wherein the control section executes the end portion region pressing shift between the width end portion of the folded loop near the initial position and the initial position by the support unit, then executes the entire region pressing shift, and subsequently to the entire region pressing shift, executes the end portion region pressing shift between the width end portion of the folded loop near the end position and the end position.

19. A sheet fold pressing method of pressing a fold of a folded loop of folding sheets by shifting a support unit, provided with pairs of press rollers adapted to press the folded loop of folding sheets, and the support unit adapted to shift from an initial position to an end position in a width direction of the folding sheets, while supporting as rows with a distance between the press rollers being narrowed stepwise from downstream to upstream in a shift direction of the support unit from the initial position where the plurality of rows is apart from one end portion of the folding sheets in a width direction of the folding sheets to the end position where the plurality of rows is apart from the other end portion of the folding sheets in the width direction of the folding sheets, including:

a sheet width entire region pressing step of shifting the support unit in a sheet width entire region of the folded loop to press the sheets; and a folded loop end portion pressing step of performing a reciprocating motion of the support unit between the folded loop end portion of the folded loop where the plurality of rows is on the folded loop and at least one of the end position and the initial position.

* * * * *